US011123784B2

(12) United States Patent
Imamura et al.

(10) Patent No.: US 11,123,784 B2
(45) Date of Patent: Sep. 21, 2021

(54) TUBE-MEMBER-FORMING METHOD

(71) Applicants: KOBE STEEL, LTD., Kobe (JP); TOYOTA JIDOSHA KABUSHIKI KAISHA, Toyota (JP)

(72) Inventors: Yoshihaya Imamura, Fujisawa (JP); Takayoshi Sugisaki, Fujisawa (JP); Chieko Imai, Fujisawa (JP)

(73) Assignees: KOBE STEEL, LTD., Kobe (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/628,855

(22) PCT Filed: Jul. 12, 2018

(86) PCT No.: PCT/JP2018/026403

§ 371 (c)(1),
(2) Date: Jan. 6, 2020

(87) PCT Pub. No.: WO2019/013306

PCT Pub. Date: Jan. 17, 2019

(65) Prior Publication Data

US 2020/0222965 A1 Jul. 16, 2020

(30) Foreign Application Priority Data

Jul. 12, 2017 (JP) ..... JP2017-136634
Feb. 8, 2018 (JP) ..... JP2018-021084

(51) Int. Cl.
*B21D 26/14* (2006.01)

(52) U.S. Cl.
CPC ..... *B21D 26/14* (2013.01); *Y10T 29/49803* (2015.01)

(58) Field of Classification Search
CPC ..... B21D 26/14; Y10T 29/49803
USPC ..... 72/56
See application file for complete search history.

(56) References Cited

U.S. PATENT DOCUMENTS

2003/0218333 A1* 11/2003 Barber ..... F28F 9/16 285/124.1
2006/0231587 A1 10/2006 Kiehl et al.
2008/0072584 A1* 3/2008 Cai ..... B23K 9/0286 60/322

FOREIGN PATENT DOCUMENTS

CN 1829583 A 9/2006
JP 2006-264469 A 10/2006
JP 2007-524511 A 8/2007

OTHER PUBLICATIONS

International Search Report dated Oct. 16, 2018 in PCT/JP2018/026403 filed on Jul. 12, 2018, 1 page.

* cited by examiner

*Primary Examiner* — Jermie E Cozart
(74) *Attorney, Agent, or Firm* — Oblon, McClelland, Maier & Neustadt, L.L.P.

(57) ABSTRACT

A coil unit is inserted into a tube member, an electromagnetic-forming coil part is arranged at a tube member forming position, a coil-side terminal is connected to a power-supply-side terminal of an end part of a high-voltage power supply cable, the electromagnetic-forming coil part is energized by a power supply part to electromagnetically form the tube member, the coil-side terminal and the power-supply-side terminal are separated, and the coil unit is removed from the tube member. Thus, the tube member can be separated from the high-voltage power supply cable during transport.

5 Claims, 36 Drawing Sheets

TUBE-MEMBER-FORMING METHOD

TECHNICAL FIELD

The present invention relates to a tube-member-forming method.

BACKGROUND ART

Many of structural components forming automobiles are made of steel members in view of costs thereof and workability in welding and the like. To meet, recent-year demands for improved fuel efficiency, some of such automobile structural components made of steel members are replaced with lightweight members. Application of such lightweight members not only to panel members but also to frame members has come to be considered.

In particular, frame members and reinforcements are made of elongated tube members each having a total length greater than the diameter thereof, and are provided with brackets or the like welded to the outer peripheral surfaces thereof. However, if such members are joined by welding, thermal strain may occur with high probability. Therefore, joining of members by clinching with tube expansion has been considered. It is known that clinching with tube expansion is performed by a technique of utilizing hydraulic pressure or a technique of electromagnetic forming (PTL 1).

CITATION LIST

Patent Literature

PTL 1: Japanese Unexamined Patent Application Publication No. 2006-264469

SUMMARY OF INVENTION

Technical Problem

Many of members such as frame members and reinforcements are each obtained by joining tube members having different diameters and each have an elongated shape as a whole. To process such an elongated tube member by forming with a pressure applied over the entirety thereof lengthwise, a complicated work is necessary in which portions of the tube member that do not need to be expanded are restrained with pressing tools. Moreover, in the case of tube members having different diameters, the pressure required for forming varies with the position. Therefore, it is difficult to achieve accurate tube expansion.

In addition, the tube member may have a surface for receiving another member to be joined thereto or may be provided with a jig or a fitting member for attaching a fastening member such as a rivet or a nut. In such a case, not only clinching with tube expansion but also forming of a protrusion is necessary. Therefore, in view of production efficiency and assured dimensional accuracy of the product, electromagnetic forming needs to be performed a plurality of times, with the tube member being supported by the jig or the like.

In such a case, an electromagnetic-forming coil is inserted into the elongated tube member and is moved among a plurality of forming positions, at each of which the electromagnetic-forming coil is fixed so that electromagnetic forming is performed. A high-voltage power cable for supplying an electric current, to the electromagnetic-forming coil is connected to a terminal at an end of the electromagnetic-forming coil. High-voltage power cables are less flexible and are therefore difficult to fold or extend in a narrow space. That is, a space accommodating a length of stroke by which the electromagnetic-forming coil is moved back and forth is necessary. Inevitably, the size of the facility is increased, which is a problem. Furthermore, every time the coil is moved, the high-voltage power cable is also moved. Therefore, the high-voltage power cable may wear or be damaged. In this respect, the cable cannot be moved over a wide range, which restricts the space available for electromagnetic forming. Consequently, some of a plurality of portions of the elongated tube that need to be processed may be unable to be processed.

The present invention is to solve the above problems and to provide a tube-member-forming method that realizes a reduction in the space of a facility even for processing of elongated tube members and that also realizes various kinds of processing with high flexibility and high accuracy.

Solution to Problem

The present invention provides the following.

(1) A tube-member-forming method comprising, in the following order:

a unit-inserting step of inserting a bar-shaped coil unit having an electromagnetic-forming coil portion into a tube member from a distal part of the coil unit;

a coil-positioning step of positioning the electromagnetic-forming coil portion at a forming position of the tube member;

a terminal-connecting step of connecting a coil-side terminal and a power-side terminal to each other, the coil-side terminal being provided in a proximal part of the coil unit and being electrically continuous with the electromagnetic-forming coil portion, the power-side terminal being provided at an end of a power cable extending from a power source;

a forming step of electromagnetically forming the tube member by supplying a current from the power source to the electromagnetic-forming coil portion;

a terminal-separating step of separating the coil-side terminal and the power-side terminal from each other; and a unit-removing step of removing the coil unit from the tube member.

According to the above tube-member-forming method, the coil unit with the power cable being separated therefrom is inserted into the tube member until the electromagnetic-forming coil portion reaches the forming position. Therefore, when the electromagnetic-forming coil portion is set, the power cable does not need to be folded or extended. Hence, there is no need to provide a wide space for the insertion of the coil unit into the tube member, leading to a reduction in the space of the facility. Furthermore, the insertion of the coil unit can be performed easily because there is no need to move the power cable, which is less flexible. Therefore, the electromagnetic-forming coil portion can be accurately brought to the forming position. Furthermore, before the coil unit is removed from the tube member, the power cable is separated from the coil unit. Hence, there is no need to move the power cable around. Therefore, the coil unit can be easily removed. Consequently, the flexibility in the positioning of the coil unit relative to the tube member is increased, the workability is improved, and electromagnetic forming can be performed in various ways with high accuracy.

(2) The tube-member-forming method according to (1), wherein the coil-side terminal and the power-side terminal each have a plate shape, and the terminal-connecting step is performed by stacking the coil-side terminal and the power-side terminal one on top of the other to be fixed.

According to the above tube-member-forming method, since the coil-side terminal and the power-side terminal each having a plate shape are stacked one on top of the other and are fixed, the coil unit and the power cable can be assuredly connected to each other with simple work. Furthermore, since the coil-side terminal and the power-side terminal each having the plate shape and having been stacked are separated from each other, the coil unit and the power cable can be separated with simple work and in a short time. Consequently, the efficiency in the work of electromagnetic forming of the tube member can be increased.

(3) The tube-member-forming method according to (2), wherein the coil-positioning step is performed by moving the coil unit such that the electromagnetic-forming coil portion is positioned among a plurality of different positions of the tube member, and wherein the terminal-connecting step, the forming step, and the terminal-separating step are performed at each of the different positions.

According to the above tube-member-forming method, electromagnetic forming can be performed at any plurality of positions of the tube member efficiently and sequentially. Furthermore, since there is no need to fold or extend the power cable when the coil unit is moved, electromagnetic forming can be performed with high workability and high accuracy.

(4) The tube-member-forming method according to any of (1) to (3), further comprising, after the terminal-separating step:

a step of transporting the tube member and the coil unit from a current processing stage to a next processing stage, with the coil unit being placed in the tube member, wherein the coil-positioning step, the terminal-connecting step, the forming step, and the terminal-separating step are performed again in that order on the next processing stage.

According to the above tube-member-forming method, before the tube member is transported with the coil unit being placed therein, the power cable is removed. Hence, there is no need to fold or extend the power cable. Consequently, electromagnetic forming can be performed with high workability and high accuracy.

Advantageous Effects of Invention

The tube-member-forming method according to the present invention realizes a reduction in the space of a facility even for processing of elongated tube members and also realizes various kinds of processing with high flexibility and high accuracy.

DESCRIPTION OF EMBODIMENTS

Embodiments of the present invention will now be described in detail with reference to the drawings.

<Configuration of Formed Body>

Figure 1:
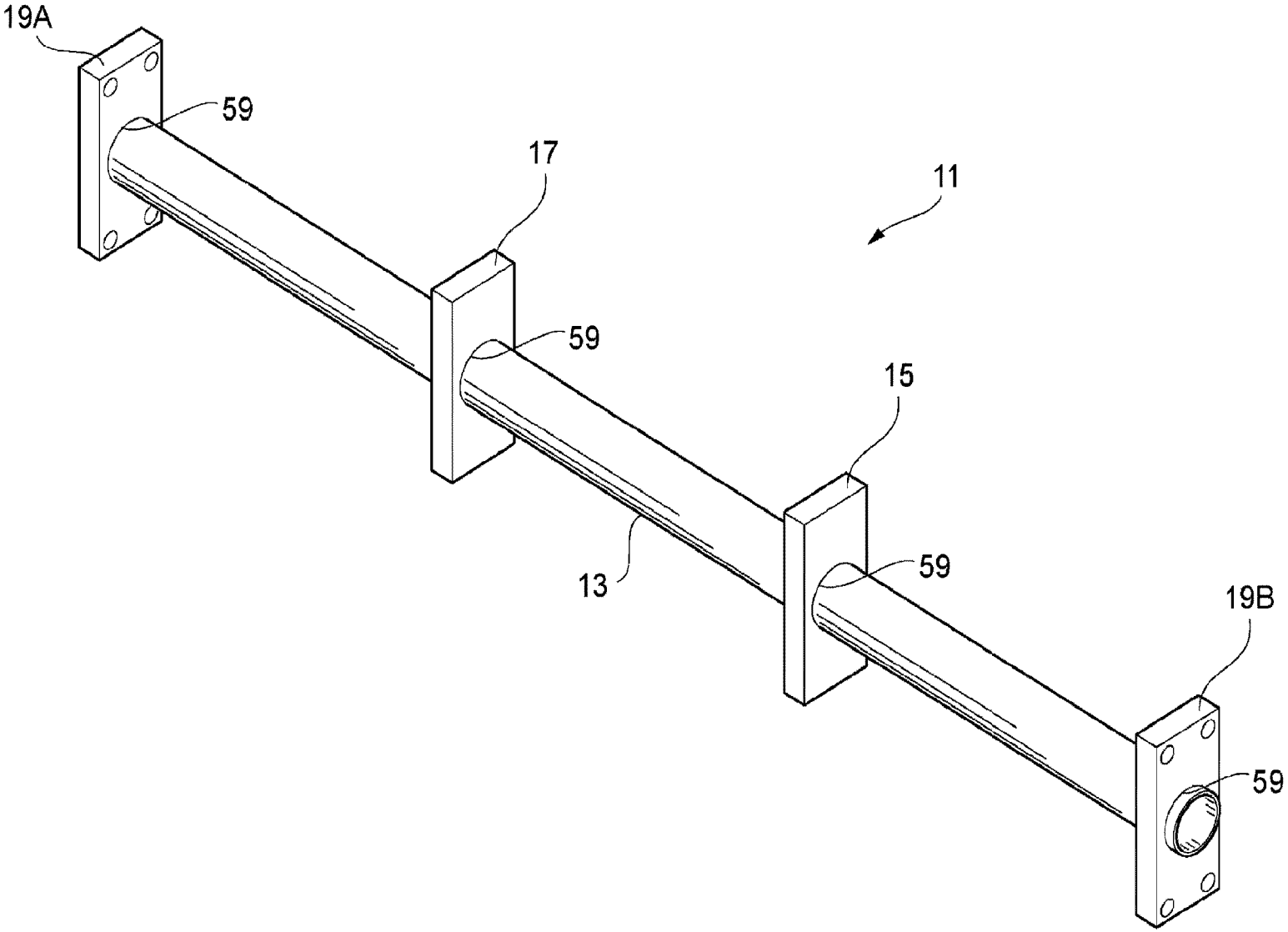
FIG. 1 is an external perspective view of a formed body obtained by electromagnetic forming of a tube member.

FIG. 1 is an external perspective view of a formed body 11 obtained by electromagnetic forming of a tube member.

The formed body 11 includes an aluminum tube member (a tube member) 13, brackets 15 and 17 provided around the outer periphery of the aluminum tube member 13, and brackets 19A and 19B provided at two respective ends of the aluminum tube member 13. The brackets 15, 17, 19A, and 19B have respective through-holes 59. The aluminum tube member 13 extends through the through-holes 59 and is fixed in that state.

The aluminum tube member 13 is not limited to a circular tube and may be a rectangular tube having a square or oblong section, a hexagonal tube having a hexagonal section, or an octagonal tube having an octagonal section. The aluminum tube member 13 is manufacturable by extrusion molding or by welding of a plate member. Materials suitable as the aluminum tube member 13 include aluminum alloys (specified by JIS 6000 and 7000 series and the like).

The brackets 15, 17, 19A, and 19B (hereinafter also collectively referred to as brackets) are rigid members that are combined with the aluminum tube member 13. Materials suitable as the brackets include steel, extruded aluminum, cast aluminum, injection-molded resin, and the like.

<First Exemplary Configuration of Electromagnetic-Forming Apparatus>

A configuration of an electromagnetic-forming apparatus will now be described that manufactures, by electromagnetic forming, the formed body 11 including the aluminum tube member 13 provided with the brackets clinched on the outer periphery thereof.

Figure 2:
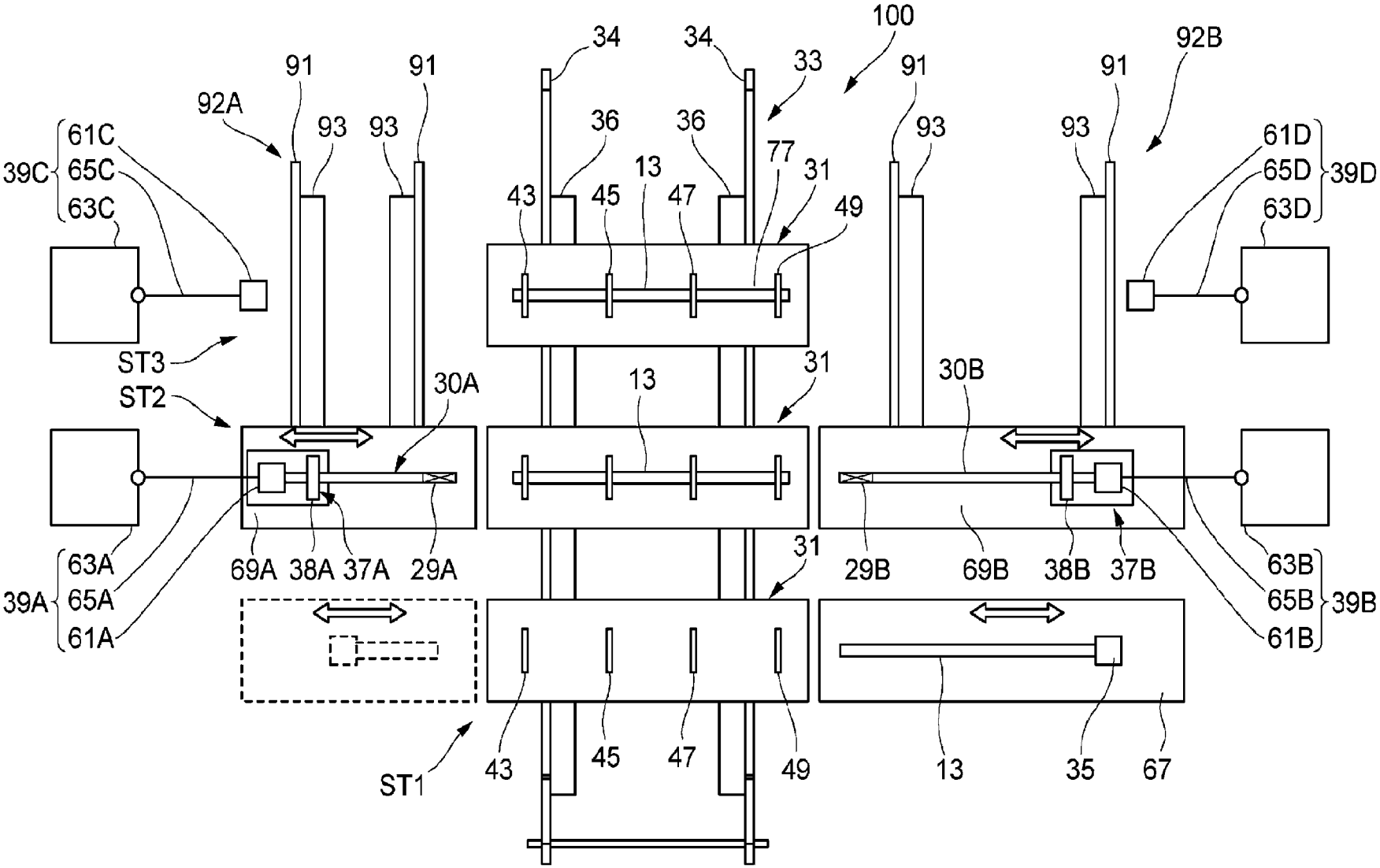
FIG. 2 is an outline plan view of an electromagnetic-forming apparatus according to a first exemplary configuration.

FIG. 2 is an outline plan view of an electromagnetic-forming apparatus 100 according to a first exemplary configuration.

The electromagnetic-forming apparatus 100 includes a plurality of jig plates 31, a jig-plate-transporting mechanism 33, a tube-inserting mechanism 35, a first coil unit 30A and a second coil unit 30B serving as electromagnetic-forming coil units, a first coil-moving mechanism 37A and a second coil-moving mechanism 37B, and current-supplying units 39A, 39B, 39C, and 39D. Details of the individual elements will be described below sequentially.

The electromagnetic-forming apparatus 100 further includes a tube-insertion stage ST1, and tube-expansion stages ST2 and ST3. Outlines of the individual stages are as follows. On the tube-insertion stage ST1, the tube-inserting mechanism 35 transfers the aluminum tube member 13 onto one of the jig plates 31. The jig-plate-transporting mechanism 33 transports the jig plate 31, having undergone tube insertion, from the tube-insertion stage ST1 to the tube-expansion stages ST2 and ST3.

On the tube-expansion stage ST2, while details will be described separately below, the first coil-moving mechanism 37A inserts the first coil unit 30A into the aluminum tube member 13 supported by the jig plate 31, and the second coil-moving mechanism 37B inserts the second coil unit 30B into the aluminum tube member 13 supported by the jig plate 31. Then, the current-supplying unit 39A energizes a first electromagnetic-forming coil portion 29A of the first coil unit 30A, and the current-supplying unit 39B energizes a second electromagnetic-forming coil portion 29B of the second coil unit 30B. Thus, the aluminum tube member 13 is electromagnetically expanded.

On the tube-expansion stage ST3, while details will be described separately below, the jig-plate-transporting mechanism 33 transports the jig plate from the tube-expansion stage ST2 to the tube-expansion stage ST3. Furthermore, a base 69A carrying the first coil unit 30A and a base 69B carrying the second coil unit 30B are transported to the tube-expansion stage ST3. Subsequently, the first electromagnetic-forming coil portion 29A of the first coil unit 30A and the second electromagnetic-forming coil portion 29B of the second coil unit 30B are inserted into the aluminum tube member 13 transported to the tube-expansion stage ST3. Then, the first electromagnetic-forming coil portion 29A is energized by the current-supplying unit 39C, and the second electromagnetic-forming coil portion 29B is energized by the current-supplying unit 39D. Thus, on the tube-expansion stage ST3, the aluminum tube member 13 is electromagnetically formed at positions different from the positions where the tube is expanded on the tube-expansion stage ST2.

<Jig Plate>

Figure 3:
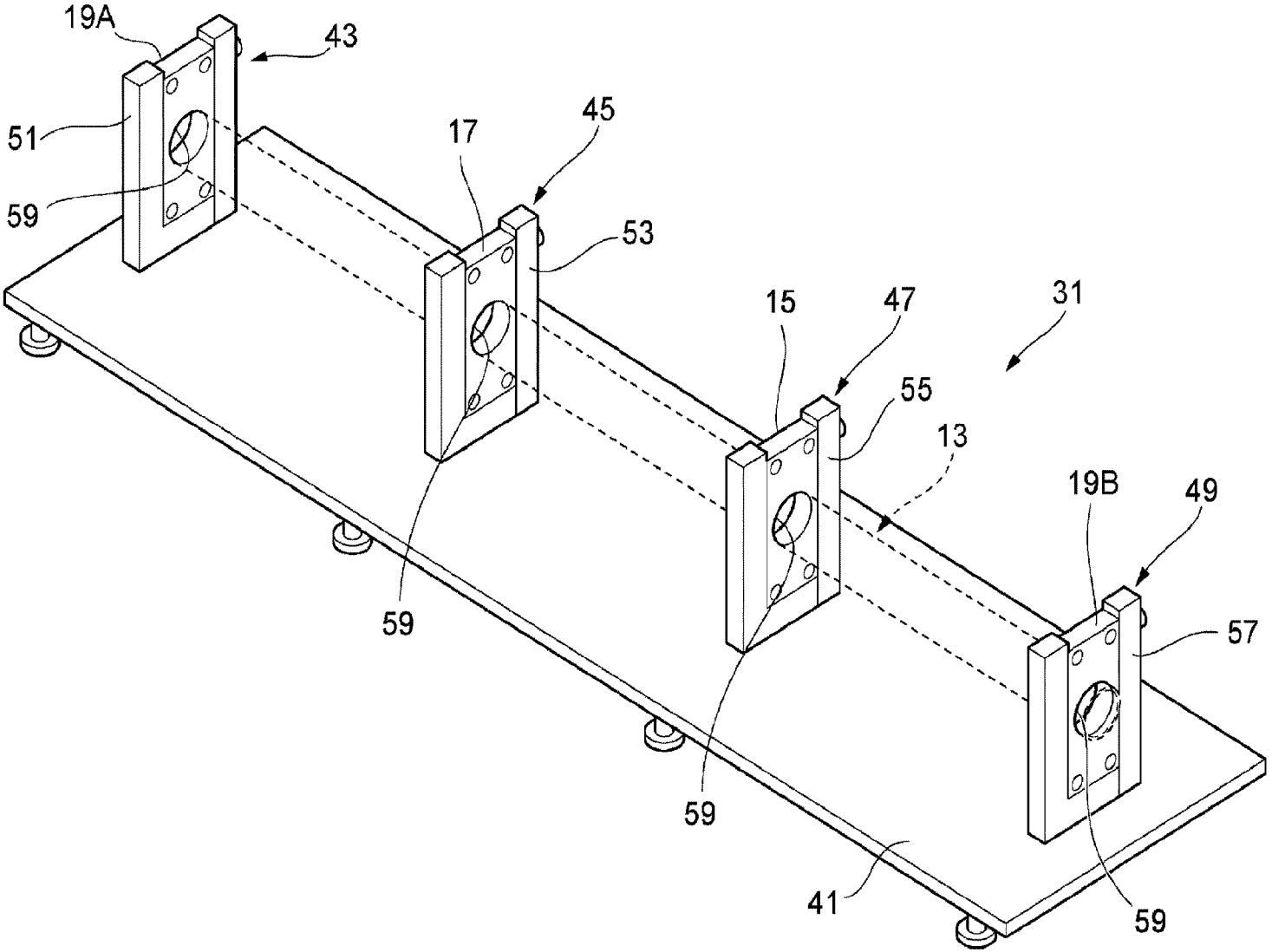
FIG. 3 is a perspective view of a jig plate.

FIG. 3 is a perspective view of the jig plate 31. FIG. 3 also illustrates the aluminum tube member 13, and the brackets 15, 17, 19A, and 19B to be fixed to the aluminum tube member 13. The aluminum tube member 13 in FIG. 3 is illustrated by dotted lines.

The jig plate 31 includes a substrate 41, and bracket holders 51, 53, 55, and 57 that are fixed to the substrate 41.

The substrate 41 is a plate of steel. Alternatively, the substrate 41 may be made of an aluminum alloy or resin instead of steel. The resin may be fiber-reinforced plastic such as carbon-fiber-reinforced plastic (CFRP).

The bracket holder 51 holds the bracket 19A, and the combination of the bracket holder 51 and the bracket 19A forms a supporting member 43 that supports the aluminum tube member 13. Likewise, the bracket holder 53 holding the bracket 17 forms a supporting member 45. The bracket holder 55 holding the bracket 15 forms a supporting member 47. The bracket holder 57 holding the bracket 19B forms a supporting member 49. The bracket holders 51, 53, 55, and 57 each fasten and secure a corresponding one of the brackets 15, 17, 19A, and 19B from the outer periphery with the aid of a toggle clamp or the like, not illustrated.

The brackets 15, 17, 19A, and 19B secured by the bracket holders 51, 53, 55, and 57 have the respective through-holes 59 positioned coaxially with one another and into which the aluminum tube member 13 is to be inserted. That is, the supporting members 43, 45, 47, and 49 standing on the jig plate 31 have the respective through-holes 59 that are all positioned coaxially with one another, and the through-holes 59 guide the aluminum tube member 13 when the aluminum tube member 13 is inserted thereinto.

To hold an elongated member, such as the aluminum tube member 13 according to the present configuration, having an axial length greater than the diameter thereof in such a manner as not to bend the member as much as possible, the jig plate 31 itself needs to be highly rigid. Therefore, the substrate 41 of the jig plate 31 is preferably a metal plate such as a steel plate or an aluminum-alloy plate.

When the electromagnetic-forming coil portions (the first electromagnetic-forming coil portion 29A and the second electromagnetic-forming coil portion 29B illustrated in FIG. 2) are energized, an induced current is generated in the aluminum tube member 13. If the induced current flows through the supporting members 43, 45, 47, and 49 to the substrate 41 of the jig plate 31, a spark may be generated. Therefore, the substrate 41 of the jig plate 31 is preferably provided with an insulating layer that is electrically insulating. The insulating layer may be made of, for example, phenolic resin (Bakelite (registered trademark)) or the like.

If the substrate 41 is provided with an insulating layer, the induced current generated in the aluminum tube member 13 is prevented from flowing out. Accordingly, the aluminum tube member 13 can be electromagnetically formed by a satisfactory amount. The insulating layer is preferably provided over the entirety of the lower surface of the substrate 41 of the jig plate 31. Thus, the flow of the induced current can be more assuredly prevented. Furthermore, unlike a case where the insulating layer is provided on the upper surface of the substrate 41, there is no displacement of the supporting members 43, 45, 47, and 49 attributed to possible variations in the thickness of the insulating layer. Therefore, if the insulating layer is provided over the lower surface of the substrate, the aluminum tube member 13 can be supported while being positioned highly accurately.

<Tube-Inserting Mechanism>

Abase 67 is provided on one side (the right side in FIG. 2) of the jig plate 31 on the tube-insertion stage ST1 illustrated in FIG. 2. The base 67 carries the tube-inserting mechanism 35. The tube-inserting mechanism 35 moves the aluminum tube member 13 in the axial direction toward the jig plate 31. Thus, the tube-inserting mechanism 35 inserts the aluminum tube member 13 into the through-holes 59 of the supporting members 43, 45, 47, and 49.

The upper surface of the substrate 41 of the jig plate 31 mounted on the jig-plate-transporting mechanism 33 and the upper surface of the base 67 extend parallel to each other. Therefore, in tube insertion, the aluminum tube member 13 is accurately held coaxially with the through-holes 59 of the supporting members 43, 45, 47, and 49 on the jig plate 31. Furthermore, since the through-holes 59 serve as guide holes that guide the aluminum tube member 13, the aluminum tube member 13 can be inserted smoothly, preventing the occurrence of misalignment.

<Electromagnetic-Forming Coil Unit>

The first coil unit 30A and the second coil unit 30B serving as the electromagnetic-forming coil units each have a bar shape and are provided on two respective sides of the tube-expansion stage ST2, across the jig plate 31 from each other. The first coil unit 30A has the first electromagnetic-forming coil portion 29A at the distal end thereof. The second coil unit 30B has the second electromagnetic-forming coil portion 29B at the distal end thereof.

Figure 4:
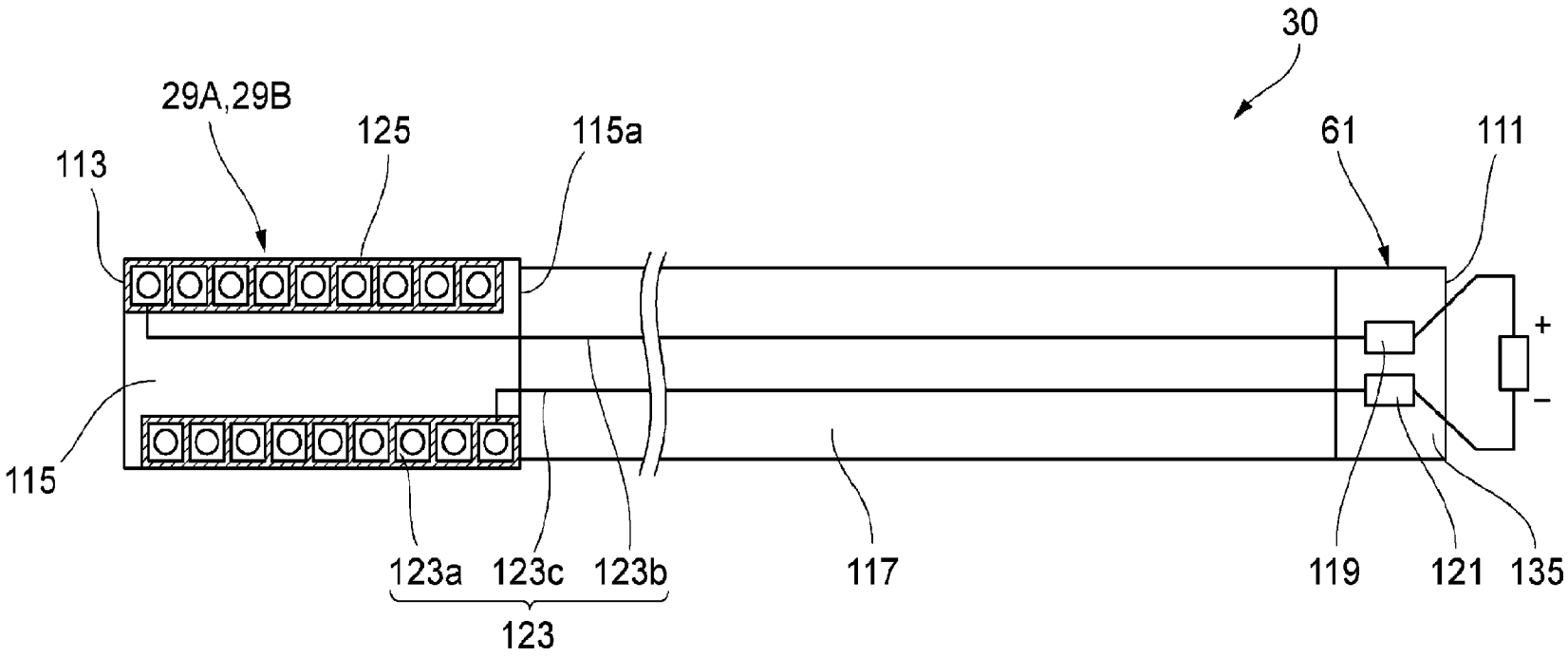
FIG. 4 is a schematic diagram of a first or second coil unit according to the first exemplary configuration.

FIG. 4 is a schematic diagram of the electromagnetic-forming coil unit according to the first exemplary configuration.

The first, coil unit, 30A and the second coil unit, 30B have the same configuration except the total lengthwise size thereof, and are therefore collectively denoted as electromagnetic-forming coil unit 30 in the following description given with reference to FIGS. 4 to 10. The electromagnetic-forming coil unit 30 extends lengthwise from a proximal end 111 to a distal end 113 and is to be inserted into the tube member (the aluminum tube member 13 illustrated in FIG. 2) from a distal part, i.e. the distal end 113, thereof so as to be used for expanding the aluminum tube member 13.

The electromagnetic-forming coil unit 30 includes a round-columnar core member 115 made of resin, an insulating support 117 that is electrically insulating, a conductor 123, and a coil-side-terminal-supporting portion 135. The insulating support 117 extends lengthwise from one end 115*a* of the core member 115 that is nearer to the proximal end 111. The conductor 123 includes an electromagnetic-forming coil portion provided around the core member 115. A terminal-connecting portion 61 is provided with coil-side terminals 119 and 121 in a proximal part, i.e. the proximal end 111, of the electromagnetic-forming coil unit 30. The coil-side terminals 119 and 121 are connected to the conductor 123.

The conductor 123 includes a wound portion 123*a* wound around the core member 115, and a pair of conductor leads 123*b* and 123*c* extending from the wound portion 123*a* toward the proximal end 111 of the insulating support 117. More specifically, the conductor lead 123*b* extends from the starting end (an end at the distal end 113) of the wound portion 123*a* through the inside of the core member 115. The conductor lead 123*c* extends from the terminal end (an end at the one end 115*a* of the core member 115) of the wound portion 123*a*.

The wound portion 123*a* of the conductor 123 is covered with an electrically insulating resin coating layer 125 provided over the outer peripheral surface thereof. The resin coating layer 125 is formed as follows. The conductor 123 around which glass-fiber tape is wound is wound around the core member 115, and resin is impregnated into the tape on the surface of the conductor 123 in the wound state. Therefore, the resin coating layer 125 is present not only over the outer periphery of the wound portion 123*a* but also between adjacent lines of the conductor 123 in the wound portion 123*a* and over the inner periphery of the wound portion 123*a*. See Japanese Unexamined Patent Application Publication No. 2004-40044 for details of the resin coating layer 125.

The core member 115, the wound portion 123*a* of the conductor 123 on the core member 115, and the resin coating layer 125 form the first electromagnetic-forming coil portion 29A (or the second electromagnetic-forming coil portion 29B likewise). That, is, the first electromagnetic-forming coil portion 29A is provided in a lengthwise region of the electromagnetic-forming coil unit 30 that corresponds to the wound portion 123*a* of the conductor 123, and so is the second electromagnetic-forming coil portion 29R.

Figure 5:
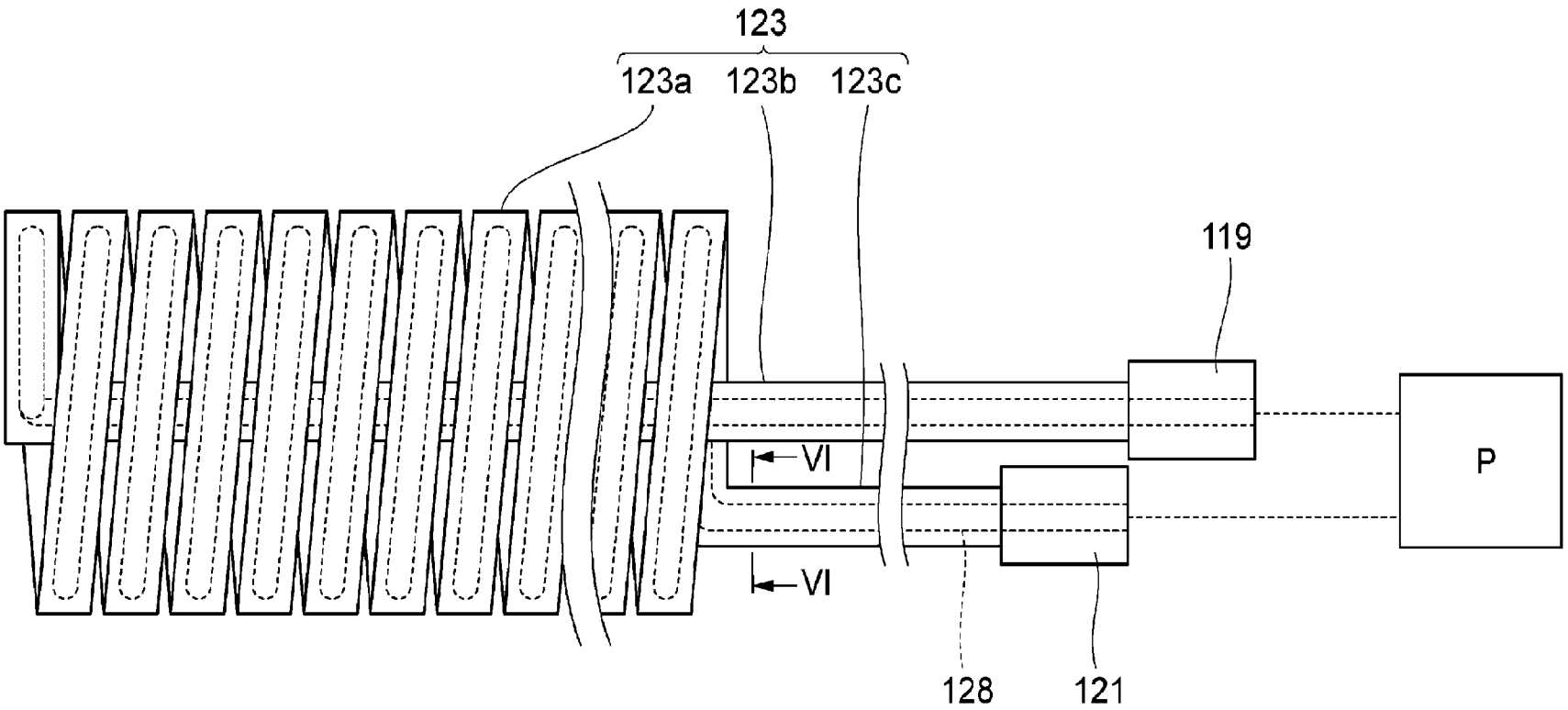
FIG. 5 is a diagram schematically illustrating a configuration of a conductor alone.
Figure 6:
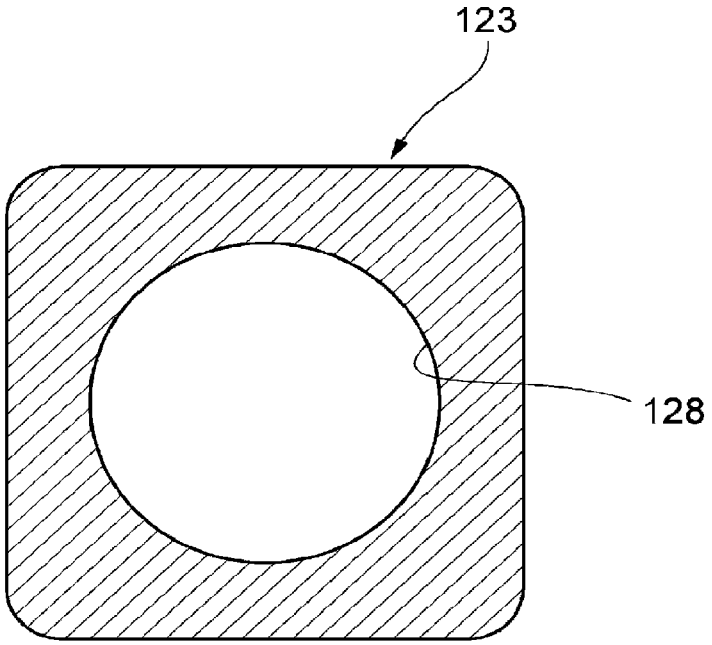
FIG. 6 is a sectional view of the conductor illustrated in FIG. 5, taken along line VI-VI.

FIG. 5 is a diagram schematically illustrating the configuration of the conductor 123 alone. FIG. 6 is a sectional view of the conductor 123 illustrated in FIG. 5, taken along line VI-VI.

The conductor 123 has a substantially square cross-sectional shape and forms a tubular conductor (a hollow conductor) having a continuous hole 128 in the center thereof. The continuous hole 128 extends lengthwise over the entirety of the conductor 123. The coil-side terminals 119 and 121 described above are connected to ends of the respective conductor leads 123*b* and 123*c*. A pump P that supplies a cooling medium is connected to the continuous hole 128 of the conductor leads 123*b* and 123*c* through the coil-side terminals 119 and 121, respectively. The cooling medium may be air, nitrogen gas, argon gas, helium gas, or the like. The cooling medium is supplied into the continuous hole 128 to cool elements, such as the wound portion 123*a* and the conductor leads 123*b* and 123*c*, which generate heat when energized for electromagnetic forming.

Figure 7:
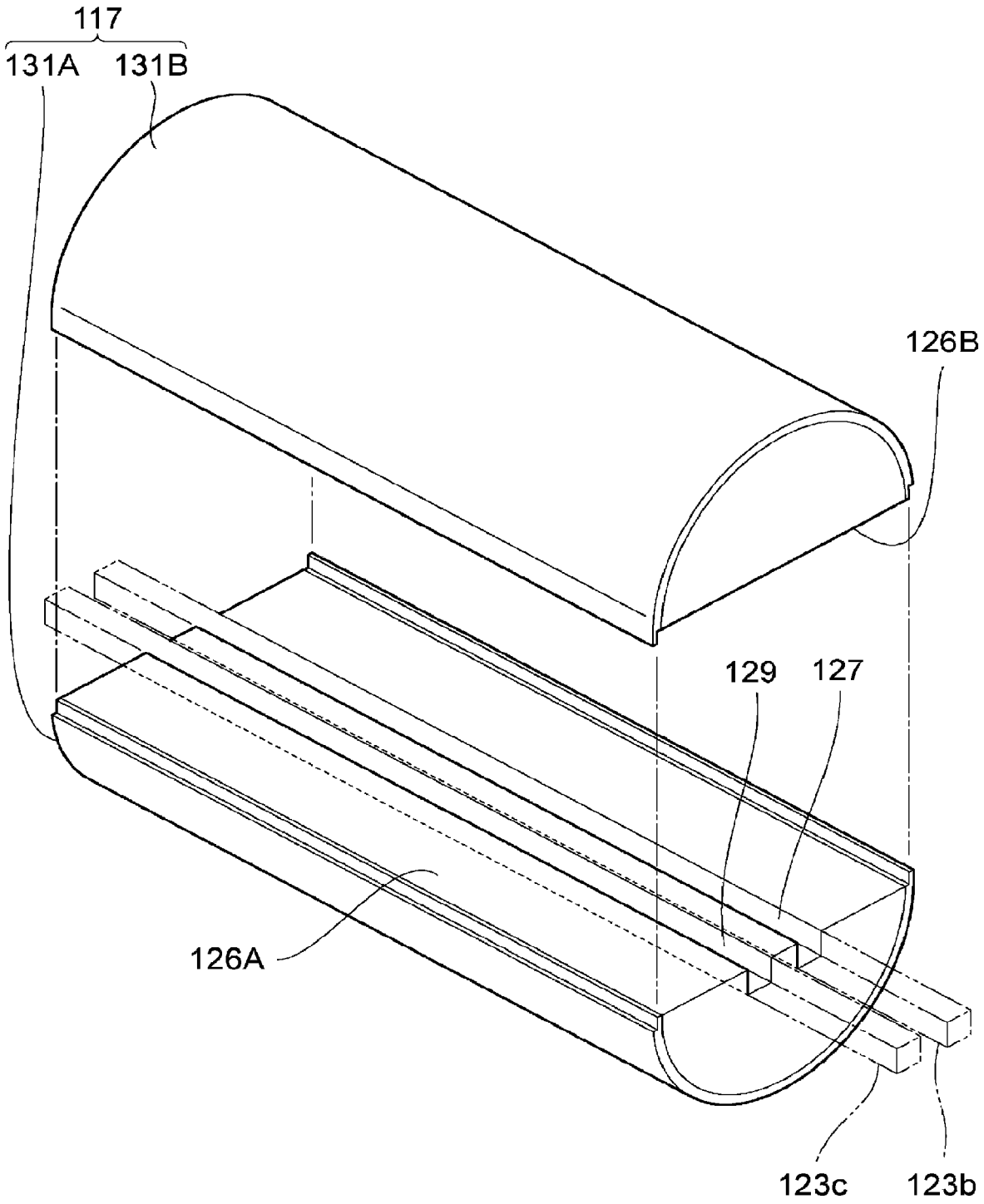
FIG. 7 is a partially exploded perspective view of an insulating support.

FIG. 7 is a partially exploded perspective view of the insulating support 117.

The insulating support 117 extends between, as illustrated in FIG. 4, the core member 115 and the proximal end 111, i.e. the terminal-connecting portion 61 provided with the coil-side terminals 119 and 121. The insulating support 117 may be integrated with the core member 115 or may be separate from the core member 115, i.e. separable from the core member 115. The insulating support 117 illustrated is a round-columnar member separate from the core member 115 and includes a pair of segments 131A and 131B whose sections taken orthogonally to the axial direction each have a semicircular shape.

An opposing segment surface 126A of one segment 131A has a pair of grooves (conductor retaining portions) 127 and 129 extending in the lengthwise direction of the insulating support 117 and retaining (securing) the pair of conductor leads 123*b* and 123*c* in such a manner as to set a constant interval therebetween. An opposing segment surface 126B of the other segment 131B that opposes the grooves 127 and 129 may be flat or have a pair of grooves likewise at corresponding positions.

Figure 8:
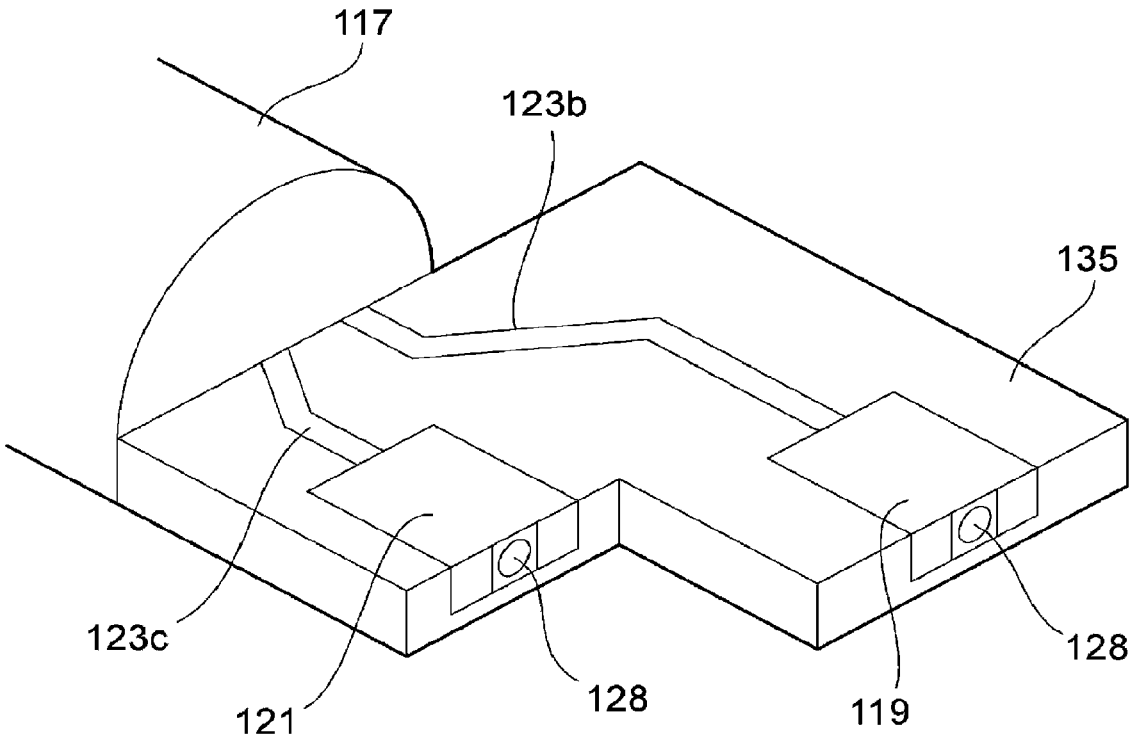
FIG. 8 is a perspective view of a coil-side-terminal-supporting portion provided at a proximal end of the insulating support.

FIG. 8 is a perspective view of the coil-side-terminal-supporting portion 135 provided at the proximal end 111 (see FIG. 4) of the insulating support 117.

The insulating support 117 is provided at the proximal end 111 thereof with the coil-side-terminal-supporting portion 135, which has a flat plate shape. The coil-side-terminal-supporting portion 135 may be integrated with the insulating support 117 or may be a plate member separate from the insulating support 117 and attached to the insulating support 117.

The coil-side-terminal-supporting portion 135 according to the present configuration has a stepped structure with parts having different lengths of projection in the lengthwise direction of the insulating support 117. The part of the stepped structure with the greater length of projection has the coil-side terminal 119, and the part with the smaller length of projection has the coil-side terminal 121. The coil-side terminals 119 and 121 are each a plate-shaped metal member and are fixed to the coil-side-terminal-supporting portion 135 in such a manner as to be spaced apart from each other.

Figure 9:
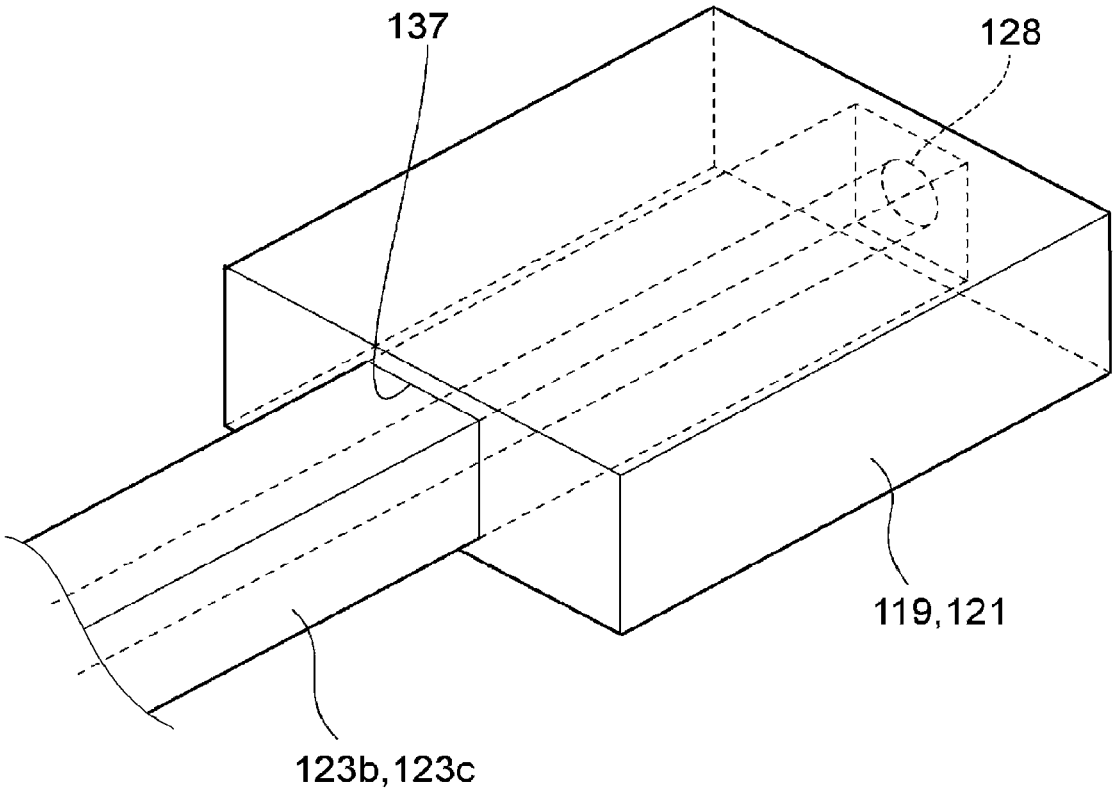
FIG. 9 is an enlarged perspective view of a coil-side terminal.

FIG. 9 is an enlarged perspective view of the coil-side terminal 119 or 121. The coil-side terminals 119 and 121 each have a conductor-securing hole 137 extending therethrough. The conductor-securing hole 137 of the coil-side terminal 119 receives an end of the conductor lead 123*b*. The conductor-securing hole 137 of the coil-side terminal 121 receives an end of the conductor lead 123*c*. The ends of the conductor leads 123*b* and 123*c* are fixed to the coil-side terminals 119 and 121, respectively, by brazing or the like.

Figure 10:
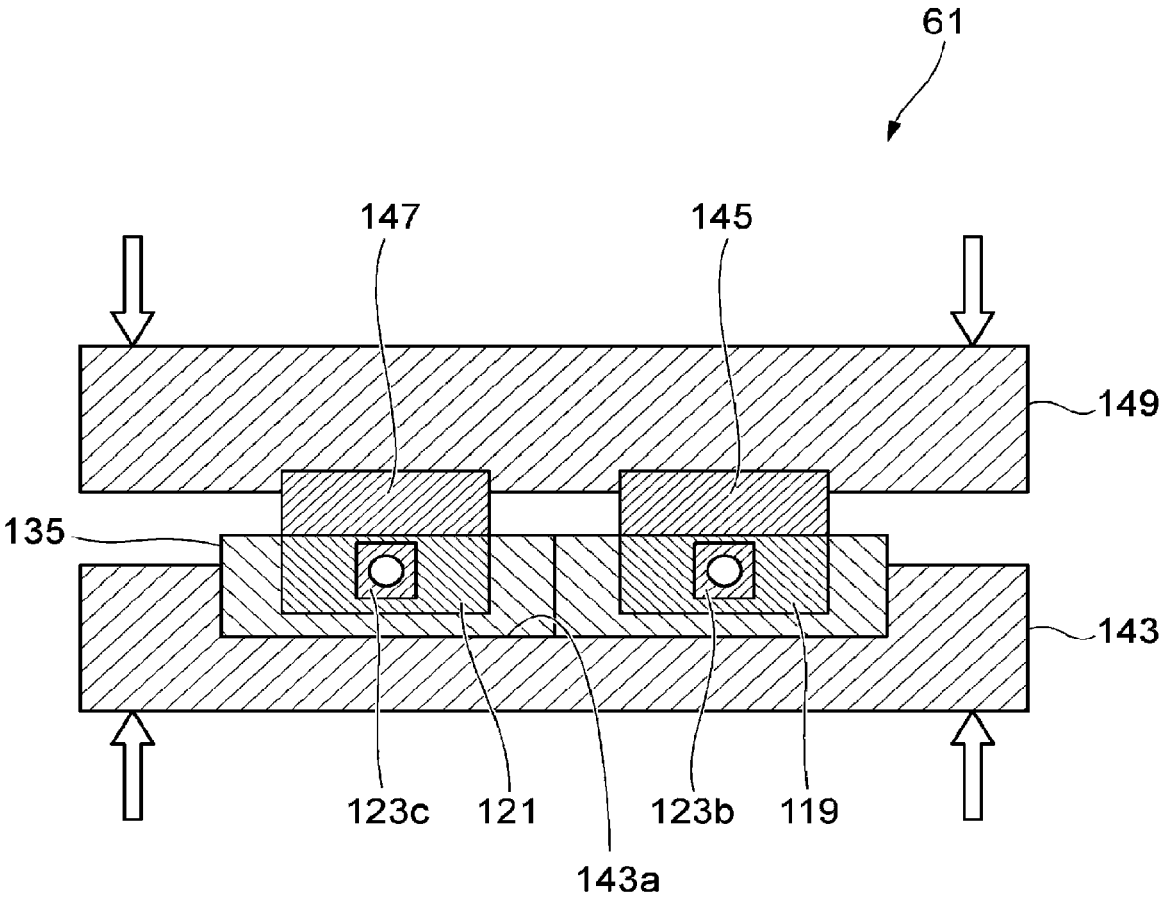
FIG. 10 is a schematic sectional view of the coil-side-terminal-supporting portion, illustrated in FIG. 8, held between a supporting table and a pressing member.

FIG. 10 is a schematic sectional view of the coil-side-terminal-supporting portion 135, illustrated in FIG. 8, held between a supporting table 143 and a pressing member 149.

The coil-side-terminal-supporting portion 135 is held at the terminal-connecting portion 61. The terminal-connecting portion 61 includes the supporting table 143, which has a supporting surface 143*a* that supports the lower side of the insulating support 117; the pressing member 149, which is provided above the supporting table 143 and facing the coil-side terminals 119 and 121; and a clamp, not illustrated, clamping the pressing member 149 and the supporting table 143 to each other with the coil-side-terminal-supporting portion 135 held therebetween.

The pressing member 149 has power-side terminals 145 and 147 fixed thereto, with respective lower portions having flat surfaces projecting from the pressing member 149. The power-side terminals 145 and 147 are spaced apart from each other and are positioned in correspondence with the coil-side terminals 119 and 121. Furthermore, the coil-side-terminal-supporting portion 135 is held between the supporting table 143 and the pressing member 149 that are clamped by the clamp, not illustrated. Therefore, the power-side terminal 145 and the corresponding coil-side terminal 119, and the power-side terminal 147 and the corresponding coil-side terminal 121 are pressed against each other to be electrically continuous with each other.

<Coil-Moving Mechanism>

The coil-moving mechanism will now be described.

The tube-expansion stage ST2 illustrated in FIG. 2 is provided with the bases 69A and 69B on the two respective sides of the jig plate 31. The base 69A carries the first coil-moving mechanism 37A that supports the first coil unit 30A. The base 69B carries the second coil-moving mechanism 37B that supports the second coil unit 30B.

The first coil-moving mechanism 37A includes a chucking portion 38A made of an electrically insulating material and that supports the first coil unit 30A; and a driving unit, not illustrated, including a ball spline, a linear moving mechanism, or the like. The driving unit moves the first coil unit 30A back and forth in the axial direction. Likewise, the second coil-moving mechanism 37B includes a chucking portion 38B made of an electrically insulating material and that supports the second coil unit 30B; and a driving unit, not illustrated, the same as above. The driving unit moves the second coil unit 30B back and forth in the axial direction.

The first coil-moving mechanism 37A inserts the first coil unit 30A into the aluminum tube member 13 coaxially therewith. The second coil-moving mechanism 37B inserts the second coil unit 30B into the aluminum tube member 13 coaxially therewith. The insertion of the first coil unit 30A and the second coil unit 30B may be performed simultaneously or with different timings.

The first coil-moving mechanism 37A moves the first coil unit 30A, and the second coil-moving mechanism 37B moves the second coil unit 30B, whereby the first electromagnetic-forming coil portion 29A and the second electromagnetic-forming coil portion 29B can be brought to desired forming positions, respectively.

<Current-Supplying Unit>

The current-supplying unit 39A provided to the tube-expansion stage ST2 includes a terminal-connecting portion 61A, a power source 63A, and a high-voltage power cable 65A. The terminal-connecting portion 61A supplies an electric current for electromagnetic forming to the first electromagnetic-forming coil portion 29A and is connected to the coil-side terminals 119 and 121 (see FIG. 4) provided at the proximal end of the first coil unit 30A. The high-voltage power cable 65A connects the power source 63A and the terminal-connecting portion 61A to each other. The current-supplying unit 39B includes a terminal-connecting portion 61B, a power source 63B, and a high-voltage power cable 65B. The terminal-connecting portion 61B supplies an electric current for electromagnetic forming to the second electromagnetic-forming coil portion 29B and is connected to the coil-side terminals 119 and 121 (see FIG. 4) provided at the proximal end of the second coil unit 30B. The high-voltage power cable 65B connects the power source 63B and the terminal-connecting portion 61B to each other.

When the power sources 63A and 63B are turned on with respective switches, the power sources 63A and 63B output energy, stored in respective capacitors, as pulsed high currents for a very short time of several milliseconds or less. The pulsed currents are supplied to the first electromagnetic-forming coil portion 29A and the second electromagnetic-forming coil portion 29B through the high-voltage power cables 65A and 65B, respectively. The switches may each be a gap switch, a thyratron switch, a mechanical switch, a semiconductor switch, an ignitron switch, or the like.

The current-supplying unit 39C provided to the tube-expansion stage ST3 also includes a terminal-connecting portion 61C, a power source 63C, and a high-voltage power cable 65C. The current-supplying unit 39D also includes a terminal-connecting portion 61D, a power source 63D, and a high-voltage power cable 65D.

<Jig-Plate-Transporting Mechanism>

The jig-plate-transporting mechanism 33 includes a pair of transporting rails 34, and a pair of transporting conveyors 36 provided along the respective transporting rails 34 and around which respective conveyor chains rotate. The transporting conveyors 36 carry the jig plates 31. When the conveyor chains are moved, the transporting conveyors 36 transport the jig plates 31 along the transporting rails 34. That is, the jig-plate-transporting mechanism 33 transports the jig plates 31 along the transporting rails 34 from the tube-insertion stage ST1 to the tube-expansion stages ST2 and ST3.

The jig-plate-transporting mechanism 33 may employ, other than the above scheme, any of various transport schemes such as a belt-transport scheme, a walking-beam scheme, and the like. In view of space-saving in the facility and reduction in tact time, the tube-insertion stage ST1 and the tube-expansion stages ST2 and ST3 are preferably arranged parallel to one another such that the direction of tube insertion and the direction of back-and-forth movement of the coil unit (the axial direction) become the same. Furthermore, the jig plates 31 are preferably transported in a direction orthogonal to the above axial direction.

<Coil-Transporting Mechanism>

A first coil-transporting mechanism 92A includes a pair of transporting rails 91, and a pair of transporting conveyors 93 provided along the respective transporting rails 91 and around which respective conveyor chains rotate. A second coil-transporting mechanism 92B also includes a pair of transporting rails 91, and a pair of transporting conveyors 93. The transporting conveyors 93 carry the bases 69A and 69B. When the conveyor chains are moved, the bases 69A and 69B are transported along the transporting rails 91. That is, the first coil-transporting mechanism 92A and the second coil-transporting mechanism 92B transport the bases 69A and 69B along the transporting rails 91 and between the tube-expansion stage ST2 and the tube-expansion stage ST3.

The first coil-transporting mechanism 92A and the second coil-transporting mechanism 92B may each also employ, other than the above scheme, any of various transport schemes such as a belt-transport scheme, a walking-beam scheme, and the like.

<Process of Electromagnetic Forming of Aluminum Tube Member>

A process of electromagnetically forming the aluminum tube member 13, included in the formed body 11 illustrated in FIG. 1, by using the electromagnetic-forming apparatus 100 configured as above will now be described sequentially.

Figure 11A:
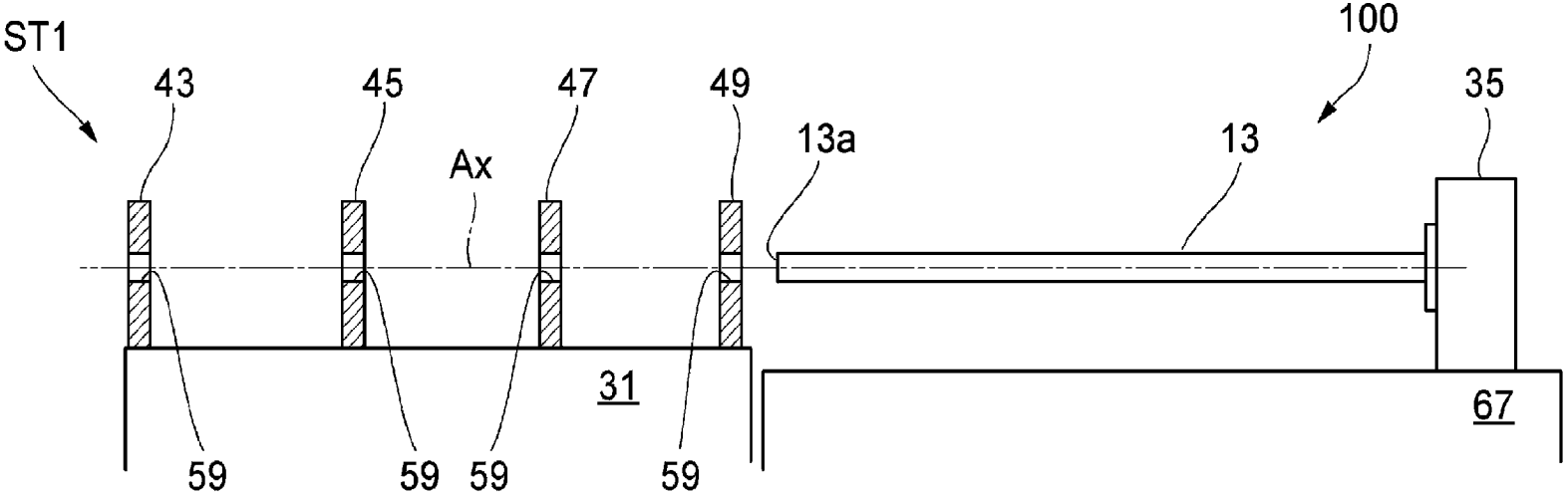
FIG. 11A is a process diagram illustrating one of a series of steps included in a tube-inserting process in which an aluminum tube member is inserted into supporting members provided on the jig plate.
Figure 11B:
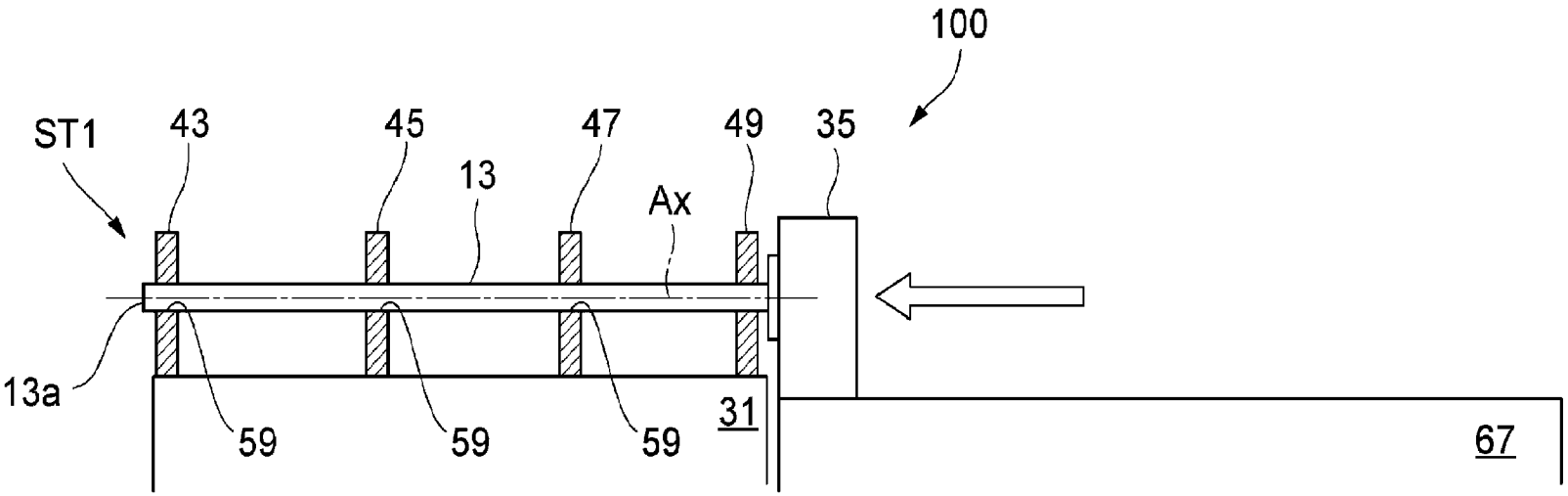
FIG. 11B is a process diagram illustrating another one of the series of steps included in the tube-inserting process in which the aluminum tube member is inserted into the supporting members provided on the jig plate.

FIGS. 11A and 11B are process diagrams illustrating a series of steps included in a tube-inserting process in which an aluminum tube member 13 is inserted into the supporting members 43, 45, 47, and 49 provided on the jig plate.

First, an aluminum tube member 13 is prepared and is attached to a chucking mechanism included in the tube-inserting mechanism 35, as illustrated in FIG. 11A.

Furthermore, the brackets 19A, 17, 15, and 19B (see FIG. 3) are attached to the respective supporting members 43, 45, 47, and 49 provided on the jig plate 31. The brackets 19A, 17, 15, and 19B are secured by the respective bracket holders 51, 53, 55, and 57 such that the through-holes 59 are positioned coaxially with one another. That is, the aluminum tube member 13 and the through-holes 59 of the supporting members 43, 45, 47, and 49 are positioned coaxially on an axis Ax.

(Tube-Inserting Step)

Subsequently, the tube-inserting mechanism 35 is activated to move the aluminum tube member 13 toward the jig plate 31 as illustrated in FIG. 11B. Accordingly, a tube end 13*a* of the aluminum tube member 13 passes through the through-holes 59 of the supporting member 49, the supporting member 47, the supporting member 45, and the supporting member 43 in that order. Thus, the tube end 13*a* projects from the through-hole 59 of the supporting member 43.

In this state, the aluminum tube member 13 extends on the axis Ax and is positioned by being held accurately coaxially with the supporting members 43, 45, 47, and 49. After the tube-inserting mechanism 35 transfers the aluminum tube member 13 onto the jig plate 31, the tube-inserting mechanism 35 returns to a retracted position illustrated in FIG. 11A.

(Step of Transport to Tube-Expansion Stage)

Subsequently, the jig-plate-transporting mechanism 33 transports the jig plate 31, having received the aluminum tube member 13 as described above on the tube-insertion stage ST1 illustrated in FIG. 2, to the tube-expansion stage ST2.

Figure 12A:
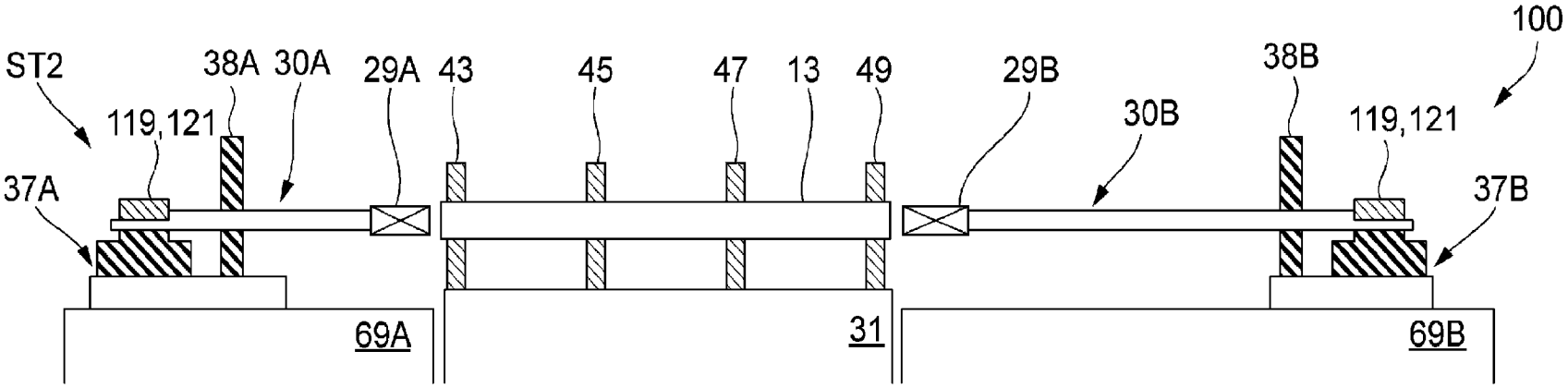
FIG. 12A is a process diagram illustrating one of a series of steps included in a tube-expanding process in which the aluminum tube member is expanded by inserting electromagnetic-forming coil portions into the aluminum tube member supported by the jig plate.
Figure 12B:
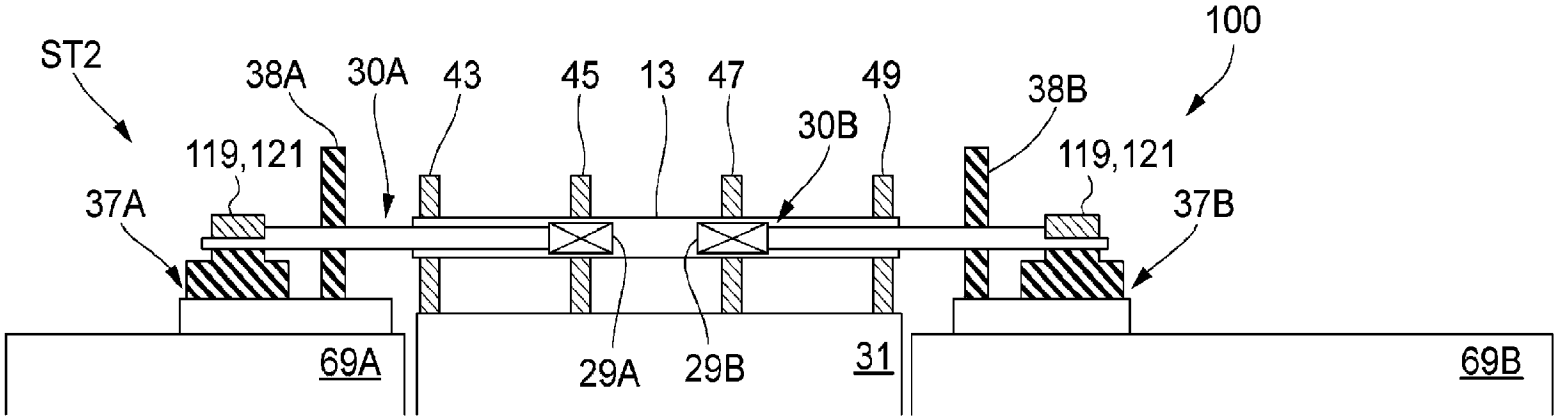
FIG. 12B is a process diagram illustrating another one of the series of steps included in the tube-expanding process in which the aluminum tube member is expanded by inserting the electromagnetic-forming coil portions into the aluminum tube member supported by the jig plate.
Figure 12C:
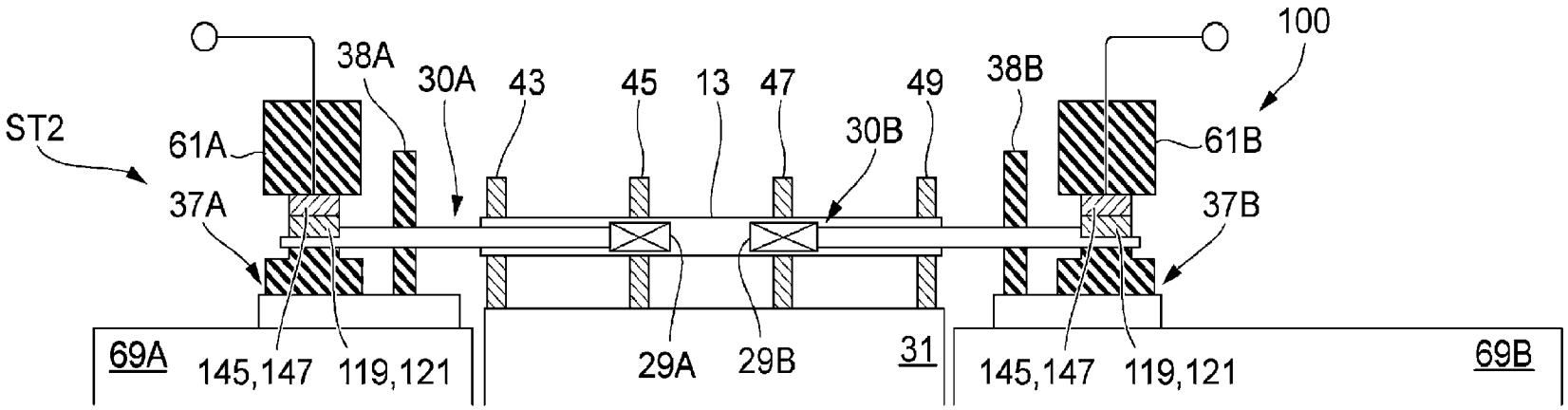
FIG. 12C is a process diagram illustrating yet another one of the series of steps included in the tube-expanding process in which the aluminum tube member is expanded by inserting the electromagnetic-forming coil portions into the aluminum tube member supported by the jig plate.

FIGS. 12A, 12B, and 12C are process diagrams illustrating a series of steps included in a tube-expanding process in which the aluminum tube member 13 is expanded by inserting the electromagnetic-forming coil portions into the aluminum tube member 13 supported by the jig plate 31.

As illustrated in FIG. 12A, the jig plate 31 transported to the tube-expansion stage ST2 coaxially faces the first coil unit 30A supported by the chucking portion 38A of the first coil-moving mechanism 37A and also faces the second coil unit 30B supported by the chucking portion 38B of the second coil-moving mechanism 37B.

(Coil-Unit-Inserting Step)

Subsequently, as illustrated in FIG. 12B, the first coil-moving mechanism 37A and the second coil-moving mechanism 37B move the first coil unit 30A and the second coil unit 30B, respectively, toward the jig plate 31. Thus, the first coil unit 30A and the second coil unit 30B are inserted into the aluminum tube member 13.

(Coil-Positioning Step)

Then, the first electromagnetic-forming coil portion 29A at the distal end of the first coil unit 30A is moved to an axial-direction position coinciding with the supporting member 45. The first coil unit 30A at this position is fixed in the axial direction by the first coil-moving mechanism 37A. Meanwhile, the second electromagnetic-forming coil portion 29B at the distal end of the second coil unit 30B is moved to an axial-direction position coinciding with the supporting member 47. The second coil unit 30B at this position is fixed in the axial direction by the second coil-moving mechanism 37B.

(Terminal-Connecting Step)

As illustrated in FIG. 12C, the power-side terminals 145 and 147 included in the terminal-connecting portions 61A and 61B of the current-supplying units 39A and 39B (see FIG. 2) are connected to the coil-side terminals 119 and 121, respectively, included in the first coil unit 30A and the second coil unit 30B. Specifically, the pressing members 149 are placed over the respective supporting tables 143 (see FIG. 10) that support the respective coil-side-terminal-supporting portions 135 (see FIG. 8) of the first coil unit 30A and the second coil unit 30B, whereby the coil-side terminals 119 and 121 are stacked on the power-side terminals 145 and 147, respectively. In this state, the pressing members 149 and the respective supporting tables 143 are clamped by the respective clamps, not illustrated. Thus, each of the coil-side terminals 119 and a corresponding one of the power-side terminals 145 are connected to each other, and each of the coil-side terminals 121 and a corresponding one of the power-side terminals 147 are connected to each other.

Figure 13A:
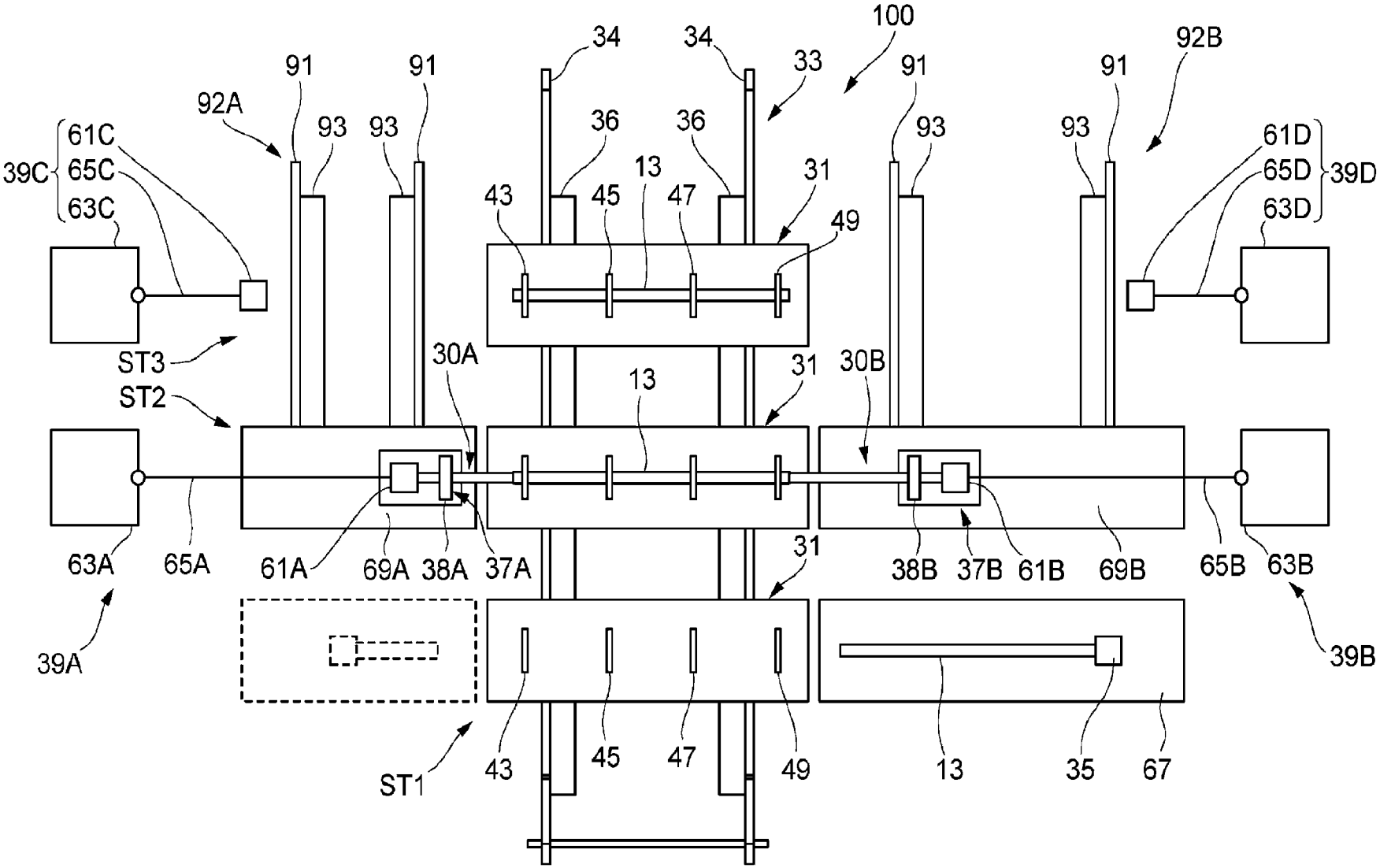
FIG. 13A is an outline plan view of the electromagnetic-forming apparatus in a terminal-connecting step illustrated in FIG. 12C.

FIG. 13A is an outline plan view of the electromagnetic-forming apparatus 100 in the terminal-connecting step illustrated in FIG. 12C. In this state, the terminal-connecting portions 61A and 61B of the power sources 63A and 63B are connected to the first coil unit 30A and the second coil unit 30B, respectively, on the tube-expansion stage ST2.

(Forming Step)

Subsequently, in the state illustrated in FIG. 12C, the current-supplying units 39A and 39B (see FIG. 13A) energize the first electromagnetic-forming coil portion 29A and the second electromagnetic-forming coil portion 29B, respectively. Accordingly, the aluminum tube member 13 is electromagnetically expanded at the supporting member 45 and at the supporting member 47 and is clinched by the supporting members 45 and 47.

(Terminal-Separating Step)

Figure 12D:
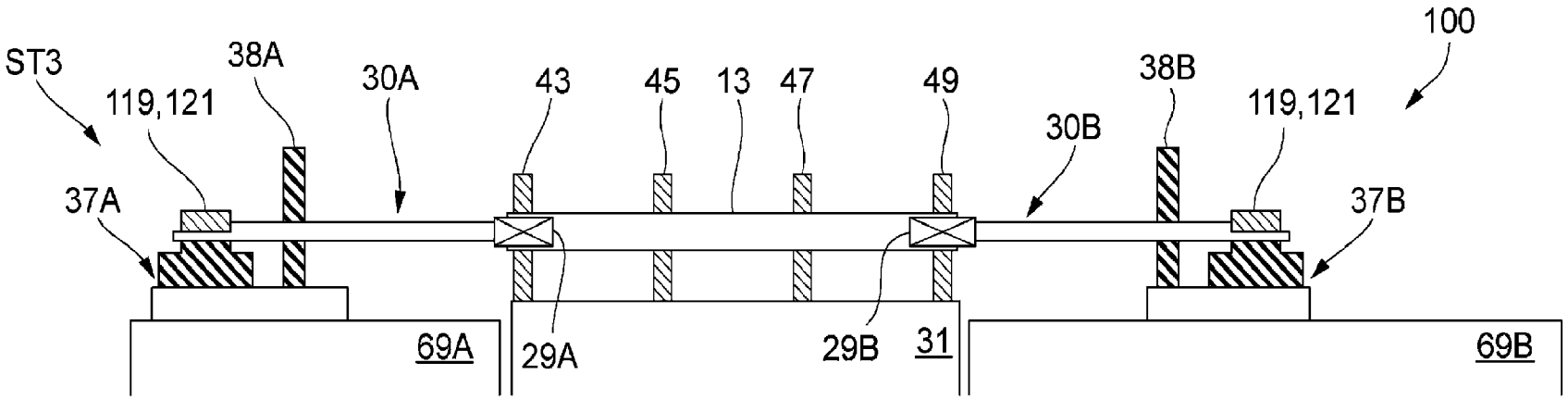
FIG. 12D is a process diagram illustrating one of a series of steps included in another tube-expanding process in which the tube is expanded by inserting and bringing each of the electromagnetic-forming coil portions to a position different from that of the case illustrated in FIG. 12B.

As illustrated in FIG. 12D, the power-side terminals 145 and 147 (see FIG. 12C) are separated, i.e. disconnected, from the coil-side terminals 119 and 121 of the first coil unit 30A and the second coil unit 30B. Specifically, the clamps that are clamping the pressing members 149 illustrated in FIG. 10 to the respective supporting tables 143 are loosened, and the pressing members 149 are thus removed from the supporting tables 143.

(Step of Moving to Next Processing Stage)

Subsequently, the jig plate 31 supporting the aluminum tube member 13 with the first coil unit 30A and the second coil unit 30B being placed therein is moved by the jig-plate-transporting mechanism 33 from the tube-expansion stage ST2, i.e. the current processing stage, to the tube-expansion stage ST3, i.e. the next processing stage.

(Coil-Repositioning Step)

Figure 13B:
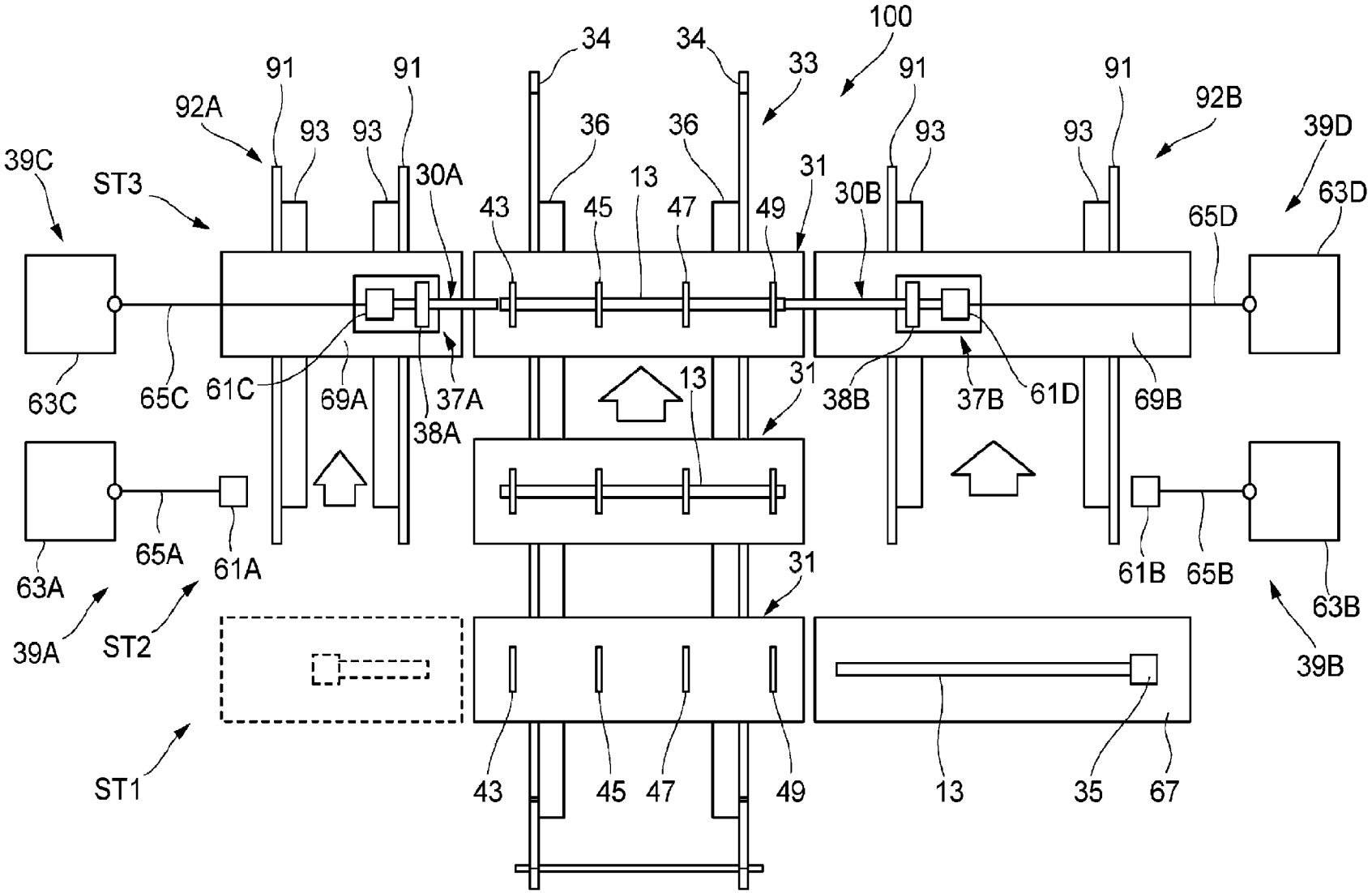
FIG. 13B is an outline plan view of the electromagnetic-forming apparatus in a moving step.

FIG. 13B is an outline plan view of the electromagnetic-forming apparatus 100 in the moving step.

In this step, the bases 69A and 69B are transported by the first coil-transporting mechanism 92A and the second coil-transporting mechanism 92B synchronously with the jig plate 31 transported by the jig-plate-transporting mechanism 33. Thus, the first coil unit 30A and the second coil unit 30B are moved to the tube-expansion stage ST3, i.e. the next processing stage. That is, the aluminum tube member 13, the first coil unit 30A, and the second coil unit 30B are transported from the tube-expansion stage ST2 to the tube-expansion stage ST3 with the first coil unit 30A and the second coil unit 30B being placed in the aluminum tube member 13.

(Terminal-Connecting Step)

Figure 12E:
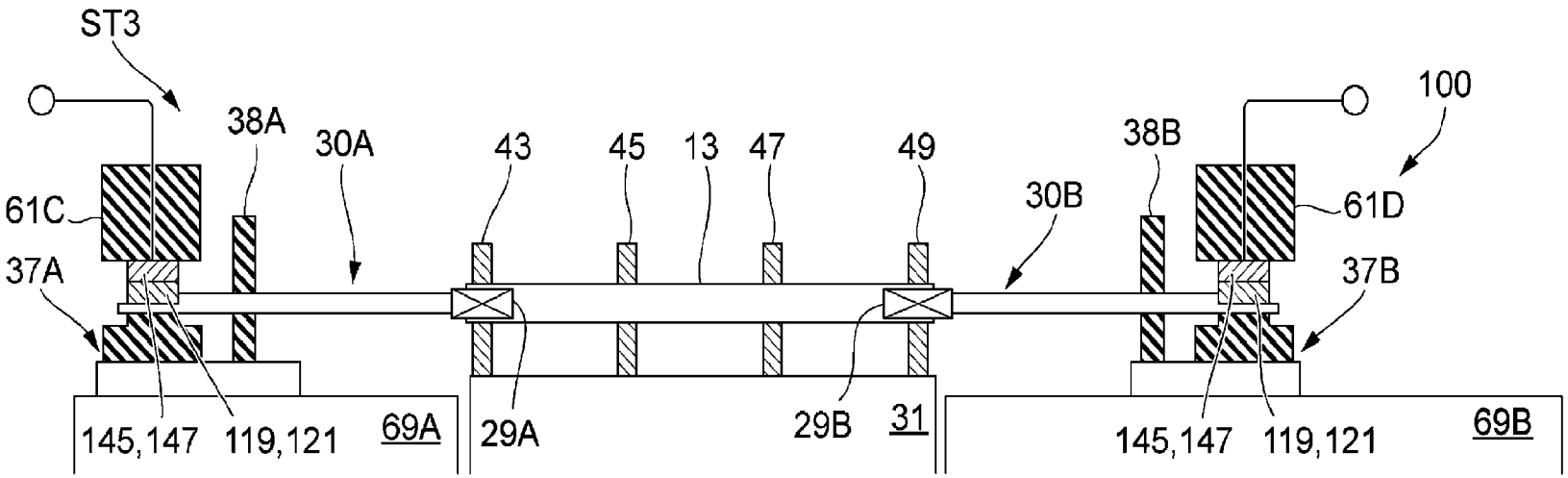
FIG. 12E is a process diagram illustrating another one of the series of steps included in the tube-expanding process in which the aluminum tube member is expanded by inserting each of the electromagnetic-forming coil portions to the position different from that of the case illustrated in FIG. 12C.

Subsequently, as illustrated in FIGS. 12E and 13B, the power-side terminals 145 and 147 (see FIG. 10) included in the terminal-connecting portions 61C and 61D of the current-supplying units 39C and 39D are connected to the coil-side terminals 119 and 121, respectively, included in the first coil unit 30A and the second coil unit 30B transported to the tube-expansion stage ST3. In the present configuration, the current-supplying units 39C and 39D are different from the current-supplying units 39A and 39B used for the tube-expansion stage ST2. Alternatively, the current-supplying units 39A and 39B may also be used for the tube-expansion stage ST3.

If necessary, as illustrated in FIG. 12D, the first coil unit 30A is moved in the axial direction by the first coil-moving mechanism 37A and is fixed when the first electromagnetic-forming coil portion 29A reaches an axial-direction position coinciding with the supporting member 43. Meanwhile, the second coil unit 30B is moved in the axial direction by the second coil-moving mechanism 37B and is fixed when the second electromagnetic-forming coil portion 29B reaches an axial-direction position coinciding with the supporting member 49. This step of positioning the coil is not necessary if there is no relative displacement between the aluminum tube member 13 and each of the first coil unit 30A and the second coil unit 30B as a result of transport of the jig plate 31.

(Forming Step)

In the above state, the current-supplying units 39C and 39D (see FIG. 13B) energize the first electromagnetic-forming coil portion 29A and the second electromagnetic-forming coil portion 29B, respectively. Accordingly, the aluminum tube member 13 is electromagnetically expanded at the positions coinciding with the supporting members 43 and 49 and is clinched by the supporting members 43 and 49.

As a result of the above process, the aluminum tube member 13 is clinched to the brackets 15, 17, 19A, and 19B.

Figure 14A:
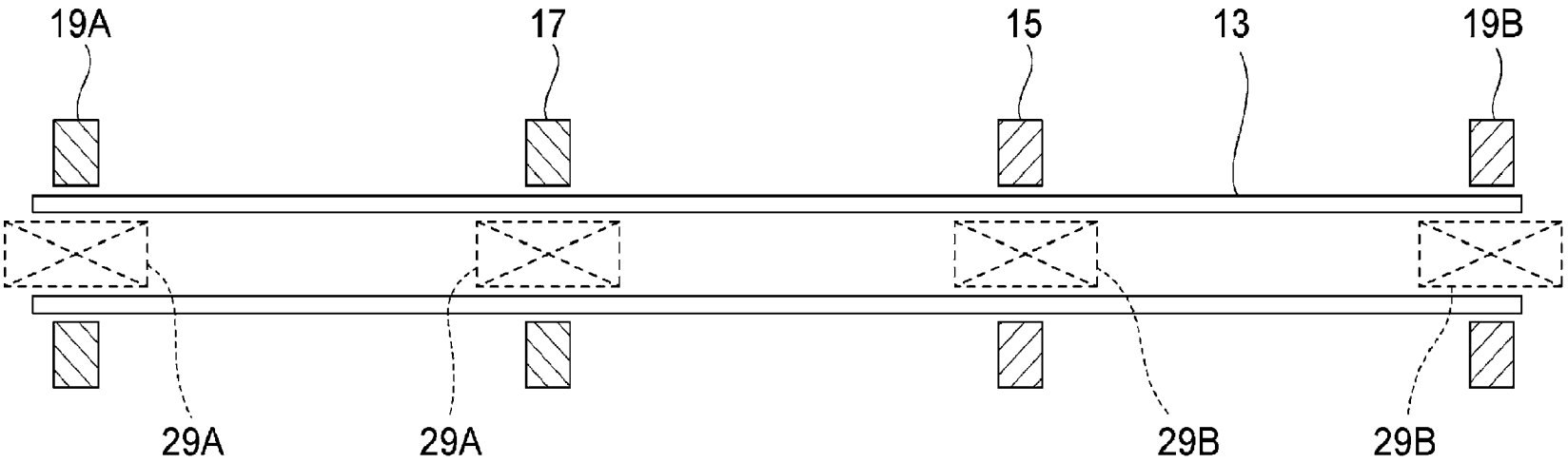
FIG. 14A is a sectional view of an aluminum tube member before undergoing electromagnetic forming.
Figure 14B:
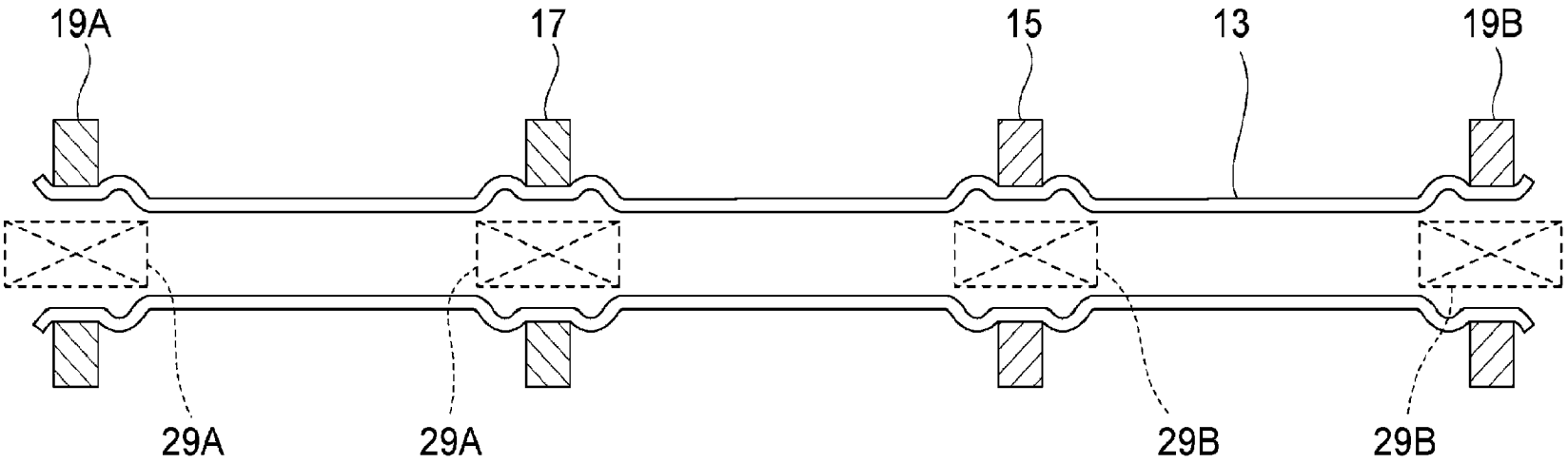
FIG. 14B is a sectional view of the aluminum tube member after undergoing electromagnetic forming.

FIG. 14A is a sectional view of an aluminum tube member 13 before undergoing electromagnetic forming. FIG. 14B is a sectional view of the aluminum tube member 13 after undergoing electromagnetic forming.

The aluminum tube member 13 after undergoing electromagnetic forming is expanded at the above positions where the first electromagnetic-forming coil portion 29A and the second electromagnetic-forming coil portion 29B have been positioned. That is, the aluminum tube member 13 electromagnetically expanded at an axial-direction position thereof coinciding with the bracket 15 is clinched to the bracket 15. Likewise, the aluminum tube member 13 is clinched to the brackets 17, 19A, and 19B at respective axial-direction positions thereof coinciding with the brackets 17, 19A, and 19B. Thus, the formed body 11 illustrated in FIG. 1 is obtained.

(Terminal-Separating Step)

Then, the power-side terminals 145 and 147 are separated, i.e. disconnected, from the coil-side terminals 119 and 121 of the first coil unit 30A and the second coil unit 30B illustrated in FIG. 12E.

(Unit-Removing Step)

Subsequently, the first coil-moving mechanism 37A and the second coil-moving mechanism 37B move the first coil unit 30A and the second coil unit 30B in respective directions away from the jig plate 31. Thus, the first coil unit 30A and the second coil unit 30B are removed from the aluminum tube member 13.

After the above step, the bracket holders 51, 53, 55, and 57 included in the supporting members 43, 45, 47, and 49 illustrated in FIG. 3 are loosened, so that the formed body 11 with the brackets fixed thereto by clinching is removed.

The formed body 11 may be removed on the tube-expansion stage ST3. Alternatively, the jig plate 31 may be transported further in the transporting direction by the jig-plate-transporting mechanism 33, and the formed body 11 may be removed at a position beyond the tube-expansion stage ST3 in the transporting direction.

<Advantageous Effects of Tube-Member-Forming Method>

According to the above tube-member-forming method, the first coil unit 30A and the second coil unit 30B, illustrated in FIG. 2, with the high-voltage power cables 65A and 65B being separated therefrom are inserted into the aluminum tube member 13 until the first electromagnetic-forming coil portion 29A and the second electromagnetic-forming coil portion 29B reach the respective forming positions. Therefore, when the first electromagnetic-forming coil portion 29A and the second electromagnetic-forming coil portion 29B are set, the high-voltage power cables 65A and 65B, which are less flexible, do not need to be folded or extended. Hence, the first coil unit 30A and the second coil unit 30B can be easily inserted into the aluminum tube member 13. Furthermore, the first electromagnetic-forming coil portion 29A and the second electromagnetic-forming coil portion 29B can be accurately brought to the respective forming positions.

Furthermore, before the first coil unit 30A and the second coil unit 30B are removed from the aluminum tube member 13, the high-voltage power cables 65A and 65B are separated from the first coil unit 30A and the second coil unit 30B. Therefore, the first coil unit 30A and the second coil unit 30B can be easily removed, with no need to fold or extend the high-voltage power cables 65A and 65B.

Hence, electromagnetic forming of the aluminum tube member 13 can be performed easily and accurately by using the first coil unit 30A and the second coil unit 30B having the first electromagnetic-forming coil portion 29A and the second electromagnetic-forming coil portion 29B, respectively.

Furthermore, since each of the plate-shaped coil-side terminals 119 and 121 and a corresponding one of the plate-shaped power-side terminals 145 and 147 are stacked one on top of the other and are fixed, the connection and the disconnection of the first coil unit 30A and the second coil unit 30B to and from the high-voltage power cables 65A and 65B can be performed assuredly and in a short time. Consequently, the efficiency in the work of electromagnetic forming of the aluminum tube member 13 can be greatly increased. Furthermore, since the high-voltage power cables 65C and 65D are also separated when the first coil unit 30A and the second coil unit 30B are moved, the efficiency in the relevant work can be increased likewise.

In electromagnetic forming, a material as an object of forming is positioned near an electromagnetic-forming coil portion, and energy stored in the coil portion is applied to the coil as a pulsed high current for a very short time of several milliseconds or less. Hence, if there is any gap between either of the coil-side terminals 119 and 121 and a corresponding one of the power-side terminals 145 and 147, a spark is generated in the gap. If the spark melts the surfaces of the terminals, the terminals may stick to each other.

In the present configuration, the coil-side terminals 119 and 121 and the power-side terminals 145 and 147 each have a plate shape and are stacked one on top of the other. Therefore, the above gap is less likely to be produced. Accordingly, sticking between the terminals can be prevented.

Preferably, the coil-side terminals 119 and 121 and the power-side terminals 145 and 147 that are stacked are pressed against each other and are fixed so that the entirety of the opposing surfaces thereof are in close contact with each other. In the terminal-connecting portion according to the present configuration, the coil-side terminals 119 and 121 and the power-side terminals 145 and 147 are pressed against, each other with the clamp. Therefore, the gap between the terminals can be eliminated as much as possible, whereby sticking between the terminals can be prevented more assuredly.

According to the present configuration, a series of the coil-positioning step, the terminal-connecting step, the forming step, and the terminal-separating step is repeated, whereby electromagnetic forming is performed at a plurality of different positions of the aluminum tube member 13. Furthermore, there is no need to fold or extend the high-voltage power cables 65A and 65B when the first coil unit 30A and the second coil unit 30B are moved. Hence, electromagnetic forming at the plurality of different positions of the aluminum tube member 13 can be performed with high workability and high accuracy.

Furthermore, relevant pairs of the high-voltage power cables 65A to 65D extending from the different power sources 63A to 63D are connected to the first coil unit 30A and the second coil unit 30B, respectively, at every shot of energy for electromagnetic forming. Therefore, if the energy to be supplied is set for the individual power sources 63A to 63D in accordance with the amount, of forming, accurate electromagnetic forming can be realized.

In the electromagnetic-forming apparatus 100 described above, processing different from the processing performed on the tube-expansion stage ST2 can be performed on the tube-expansion stage ST3. For example, on the tube-expansion stage ST2, after the aluminum tube member 13 is expanded, a mold or the like in addition to the supporting members 43, 45, 47, and 49 may be placed, whereby a protrusion may be formed in the flat surface of the tube member through a forming process using the mold. Alternatively, any kind of processing can be performed on the tube member, such as beading, embossing, drilling, or burring.

While the tube-insertion stage ST1 illustrated in FIG. 2 is configured to move the aluminum tube member 13 only from one side of the jig plate 31, the tube-insertion stage ST1 is not limited thereto. For example, as illustrated by dotted lines, the tube-insertion stage ST1 may be configured such that aluminum tube members are set onto the jig plate 31 by moving the aluminum tube members from two respective sides of the jig plate 31 in the axial direction. In such a case, the aluminum tube members have respective diameters with a difference that allows an end of one of the tube members to be inserted into an end of the other tube member to form an overlapping portion where the tube members overlap each other in the radial direction. Furthermore, the tube members are each supported by any of the supporting members 43, 45, 47, and 49.

<Second Exemplary Configuration of Electromagnetic-Forming Apparatus>

A second exemplary configuration of the electromagnetic-forming apparatus will now be described.

Figure 15:
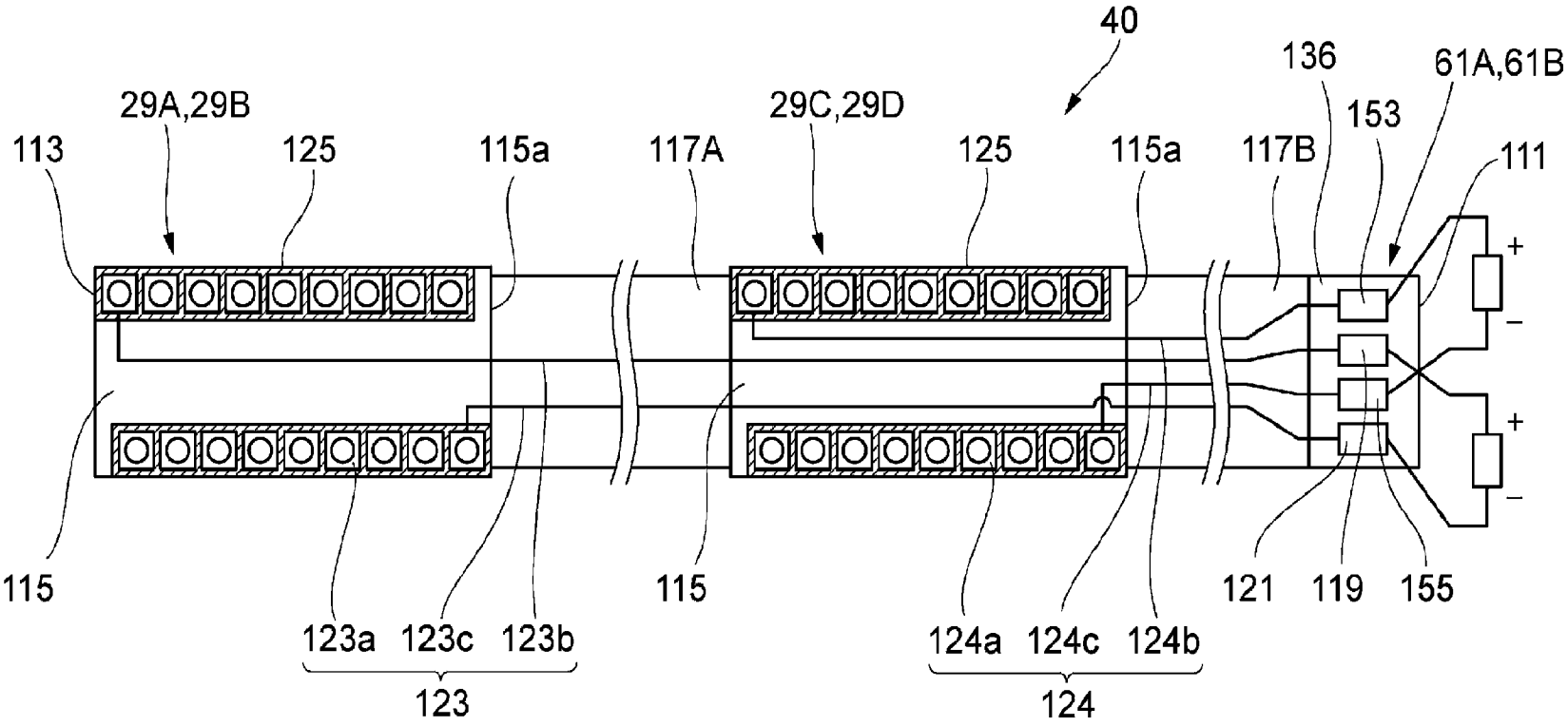
FIG. 15 is a schematic diagram of an electromagnetic-forming coil unit included in an electromagnetic-forming apparatus according to a second exemplary configuration.

FIG. 15 is a schematic diagram of an electromagnetic-forming coil unit 40 included in an electromagnetic-forming apparatus according to the second exemplary configuration.

The electromagnetic-forming coil unit 40 according to the present configuration includes a first electromagnetic-forming coil portion 29A and a third electromagnetic-forming coil portion 29C at a plurality (two in the illustrated case) of positions in the axial direction. This arrangement of coil portions also applies to a second electromagnetic-forming coil portion 29B and a fourth electromagnetic-forming coil portion 29D, description of which is therefore omitted.

The first electromagnetic-forming coil portion 29A and the third electromagnetic-forming coil portion 29C are each an independent coil portion and are energized individually. The insulating support includes an insulating support 117A provided between the first electromagnetic-forming coil portion 29A and the third electromagnetic-forming coil portion 29C, and an insulating support 117B provided between the third electromagnetic-forming coil portion 29C and the proximal end 111.

The other details are the same as those of the electromagnetic-forming coil unit 30 described above. Hereinafter, the same elements and portions are denoted by corresponding ones of the reference numerals, whereby description of each of such elements and portions is simplified or omitted.

The conductor leads 123*b* and 123*c* extend from the first electromagnetic-forming coil portion 29A in the axial direction through the insulating support 117A and the core member 115 of the third electromagnetic-forming coil portion 29C. Conductor leads 124*b* and 124*c* extend from the third electromagnetic-forming coil portion 29C through the core member 115 of the third electromagnetic-forming coil portion 29C and the insulating support 117B, and parallel to the conductor leads 123*b* and 123*c*.

In the terminal-connecting portion 61A, the proximal end of the conductor lead 124*b* is connected to a coil-side terminal 153, and the proximal end of the conductor lead 124*c* is connected to a coil-side terminal 155. The core member 115 of the first electromagnetic-forming coil portion 29A has grooves, not illustrated, for retaining (securing) the conductor leads 123*b* and 123*c*, respectively, of the conductor 123. The core member 115 of the third electromagnetic-forming coil portion 29C also has grooves, not, illustrated, for retaining (securing) the conductor leads 123*b* and 123*c* and the conductor leads 124*b* and 124*c*, respectively. The grooves extend parallel to one another at predetermined intervals.

Figure 16:
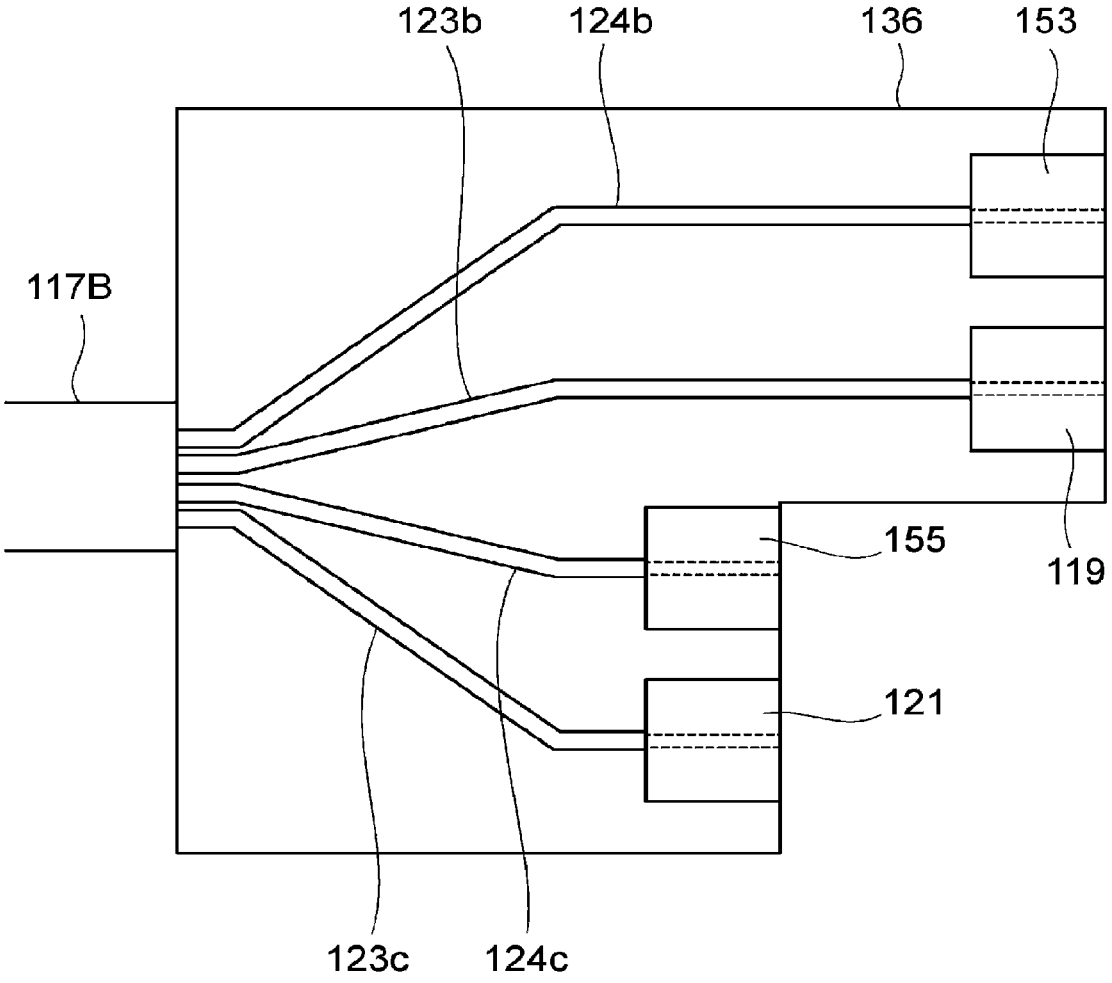
FIG. 16 is a plan view of a coil-side-terminal-supporting portion of the electromagnetic-forming coil unit.

FIG. 16 is a plan view of a coil-side-terminal-supporting portion 136 of the electromagnetic-forming coil unit 40.

As with the coil-side-terminal-supporting portion 135 (see FIG. 8) according to the first exemplary configuration, the coil-side-terminal-supporting portion 136 has a stepped structure with parts having different lengths of projection in the lengthwise direction of the insulating support 117B. The part of the stepped structure with the greater length of projection has the coil-side terminals 153 and 119, and the part with the smaller length of projection has the coil-side terminals 155 and 121. As with the coil-side terminals 119 and 121 described above, the coil-side terminals 153 and 155 are each a plate-shaped metal member and are fixed to the coil-side-terminal-supporting portion 136 while being spaced apart from each other.

Figure 17:
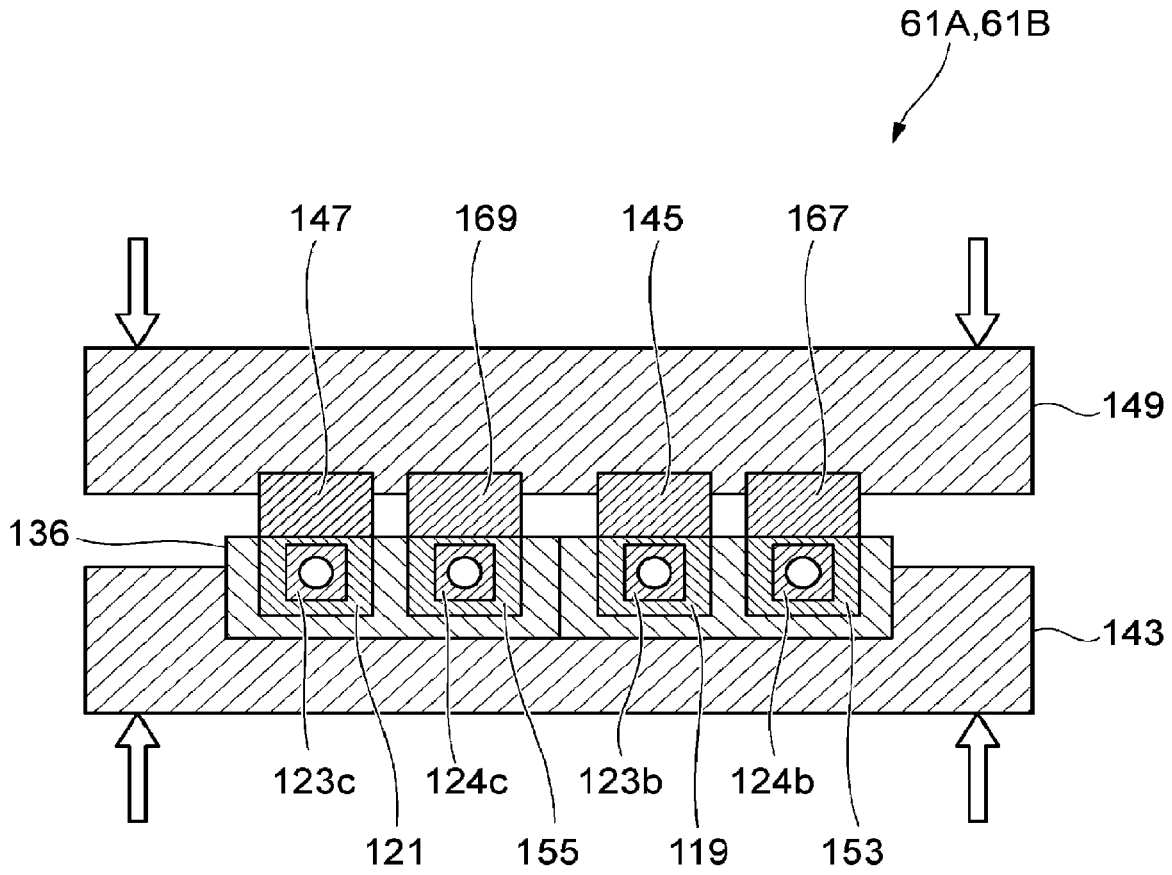
FIG. 17 is a schematic sectional view of the coil-side-terminal-supporting portion, illustrated in FIG. 16, held between a supporting table and a pressing member.

FIG. 17 is a schematic sectional view of the coil-side-terminal-supporting portion 136, illustrated in FIG. 16, held between a supporting table 143 and a pressing member 149.

As with the case of the first exemplary configuration, the coil-side-terminal-supporting portion 136 is held at the terminal-connecting portion 61A. The pressing member 149 has power-side terminals 145, 147, 167, and 169 fixed thereto. The power-side terminals 145, 147, 167, and 169 are spaced apart from one another, with respective lower portions having flat surfaces projecting from the pressing member 149. The pressing member 149 is clamped to the supporting table 143 by a clamp, not illustrated. Thus, the power-side terminal 145 and the corresponding coil-side terminal 119, the power-side terminal 147 and the corresponding coil-side terminal 121, the power-side terminal 167 and the corresponding coil-side terminal 153, and the power-side terminal 169 and the corresponding coil-side terminal 155 are pressed against each other to be electrically continuous with each other.

Figure 18A:
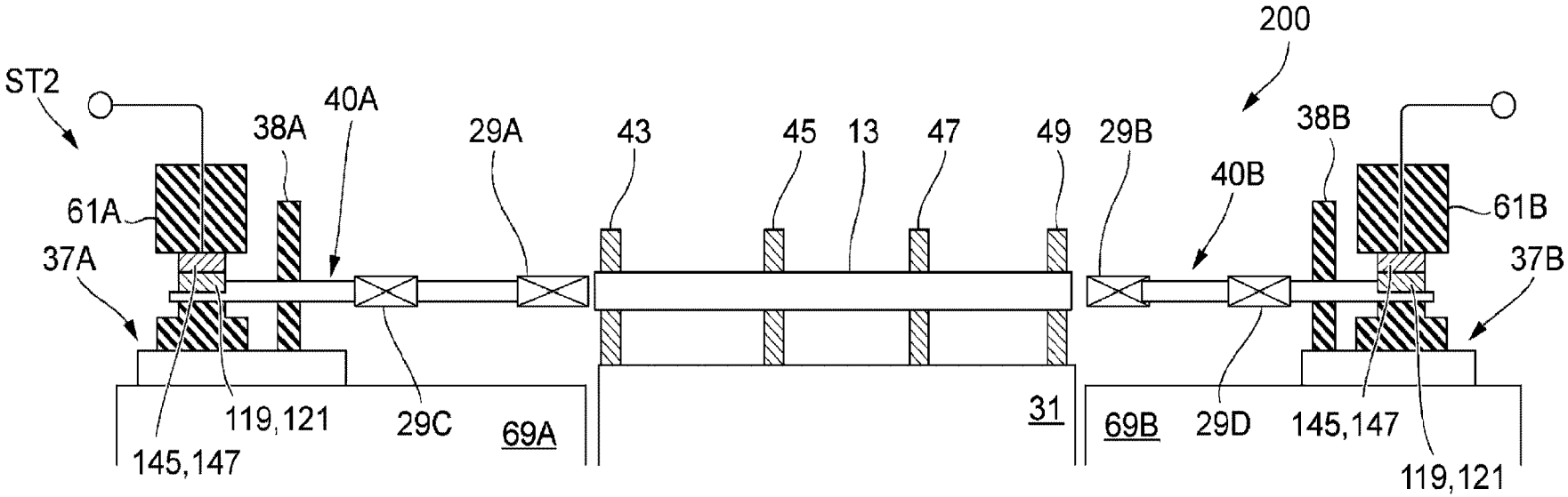
FIG. 18A is a process diagram illustrating one of a series of steps included in a tube-expanding process in which an aluminum tube member is expanded by inserting electromagnetic-forming coil portions into the aluminum tube member supported by a jig plate in the electromagnetic-forming apparatus according to the second exemplary configuration.
Figure 18B:
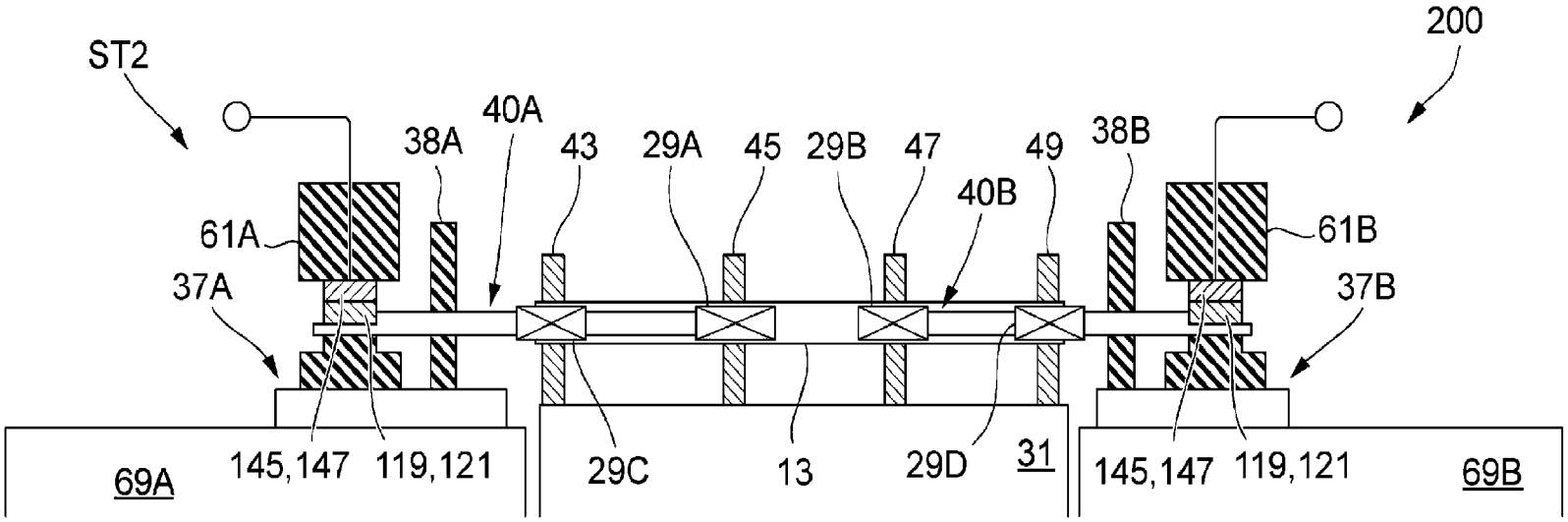
FIG. 18B is a process diagram illustrating another one of the series of steps included in the tube-expanding process in which the aluminum tube member is expanded by inserting the electromagnetic-forming coil portions into the aluminum tube member supported by the jig plate in the electromagnetic-forming apparatus according to the second exemplary configuration.

FIGS. 18A and 18B are process diagrams illustrating a series of steps included in a tube-expanding process in which an aluminum tube member 13 is expanded by inserting electromagnetic-forming coil portions into the aluminum tube member 13 supported by a jig plate 31 in the electromagnetic-forming apparatus 200 according to the second exemplary configuration.

The electromagnetic-forming apparatus 200 according to the present configuration includes a third coil unit 40A and a fourth coil unit 40B each having electromagnetic-forming coil portions at a plurality (two in the illustrated case) of positions, respectively, in the axial direction instead of the first coil unit 30A and the second coil unit 30B (see FIG. 12A) employed in the electromagnetic-forming apparatus 100 according to the first exemplary configuration described above. The other details are the same as those of the electromagnetic-forming apparatus 100 described above.

The third coil unit 40A according to the present configuration includes a first electromagnetic-forming coil portion 29A and a third electromagnetic-forming coil portion 29C in that order from the distal end thereof nearer to the jig plate 31. A portion between the first electromagnetic-forming coil portion 29A and the third electromagnetic-forming coil portion 29C and a portion on the proximal side with respect to the third electromagnetic-forming coil portion 29C form resin supports, respectively. Conductors connected to the coils are embedded in the resin supports.

Likewise, the fourth coil unit 40B includes a second electromagnetic-forming coil portion 29B and a fourth electromagnetic-forming coil portion 29D in that order from the distal end thereof nearer to the jig plate 31. A portion between the second electromagnetic-forming coil portion 29B and the fourth electromagnetic-forming coil portion 29D and a portion on the proximal side with respect to the fourth electromagnetic-forming coil portion 29D form resin supports, respectively. Conductors connected to the coils are embedded in the resin supports.

The distance between the coil centers of the first electromagnetic-forming coil portion 29A and the third electromagnetic-forming coil portion 29C is equal to the distance between the supporting member 45 and the supporting member 43. The distance between the coil centers of the second electromagnetic-forming coil portion 29B and the fourth electromagnetic-forming coil portion 29D is equal to the distance between the supporting member 47 and the supporting member 49.

The state of the electromagnetic-forming apparatus 200 according to the present configuration changes from that illustrated in FIG. 18A to that illustrated in FIG. 18B as follows: the first coil-moving mechanism 37A moves the third coil unit 40A in the axial direction, and the second coil-moving mechanism 37B moves the fourth coil unit 40B in the axial direction. When the third coil unit 40A is moved and the first electromagnetic-forming coil portion 29A reaches an axial-direction position coinciding with the supporting member 45, the third electromagnetic-forming coil portion 29C reaches an axial-direction position coinciding with the supporting member 43. Furthermore, when the fourth coil unit 40B is moved and the second electromagnetic-forming coil portion 29B reaches an axial-direction position coinciding with the supporting member 47, the fourth electromagnetic-forming coil portion 29D reaches an axial-direction position coinciding with the supporting member 49.

When the electromagnetic-forming coil portions 29A, 29B, 29C, and 29D in the state illustrated in FIG. 18B are energized, the aluminum tube member 13 is electromagnetically expanded simultaneously at the axial-direction positions coinciding with the supporting members 43, 45, 47, and 49.

The electromagnetic-forming apparatus 200 according to the present configuration includes the third coil unit 40A and the fourth coil unit 40B each having a plurality of electromagnetic-forming coil portions that are spaced apart from one another, thereby being capable of electromagnetically expanding a tube at a plurality of desired positions simultaneously. That is, a plurality of portions can be processed by changing the contact point between the terminals. Moreover, there is no need to move the coil the number of times corresponding to the number of portions to be processed. Therefore, the time consumed for moving the coil can be reduced. The electromagnetic-forming coil portions 29A, 29B, 29C, and 29D may be energized simultaneously or sequentially. In either case, there is no need to move the third coil unit 40A and the fourth coil unit 40B. Therefore, the process can be simplified.

Compared with the arrangement of the coil-side terminals 119 and 121 and the coil-side terminals 153 and 155 in that order, the arrangement of the coil-side terminals 153 (positive), 119 (positive), 155 (negative), and 121 (negative) in that order in the same arrangement direction as illustrated in FIG. 16 is preferable, because the distance between each of the positive electrodes and a corresponding one of the negative electrodes can be made longer, which reduces the probability of spark generation between the terminals.

Furthermore, the pair of the coil-side terminals 119 and 153 and the pair of the coil-side terminals 121 and 155 are staggered in a direction (the lengthwise direction of the insulating support 117B) orthogonal to the arrangement direction. That is, a longer distance is provided between the coil-side terminals 119 (positive) and 121 (negative) and between the coil-side terminals 153 (positive) and 155 (negative). In such an arrangement, the probability of spark generation is reduced further.

<Third Exemplary Configuration of Electromagnetic-Forming Apparatus>

A third exemplary configuration of the electromagnetic-forming apparatus will now be described.

Figure 19:
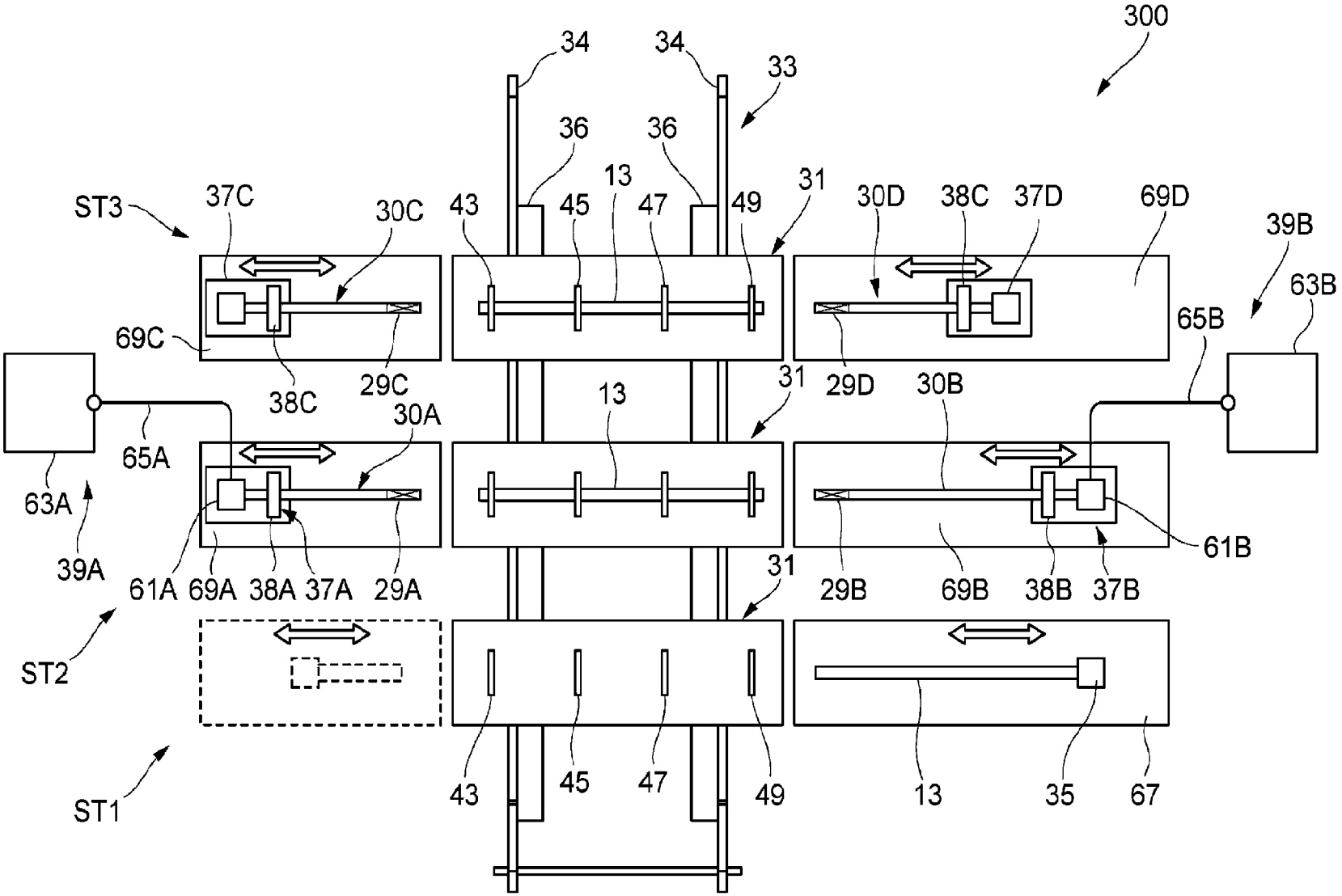
FIG. 19 is an outline plan view of an electromagnetic-forming apparatus according to a third exemplary configuration.
Figure 20A:
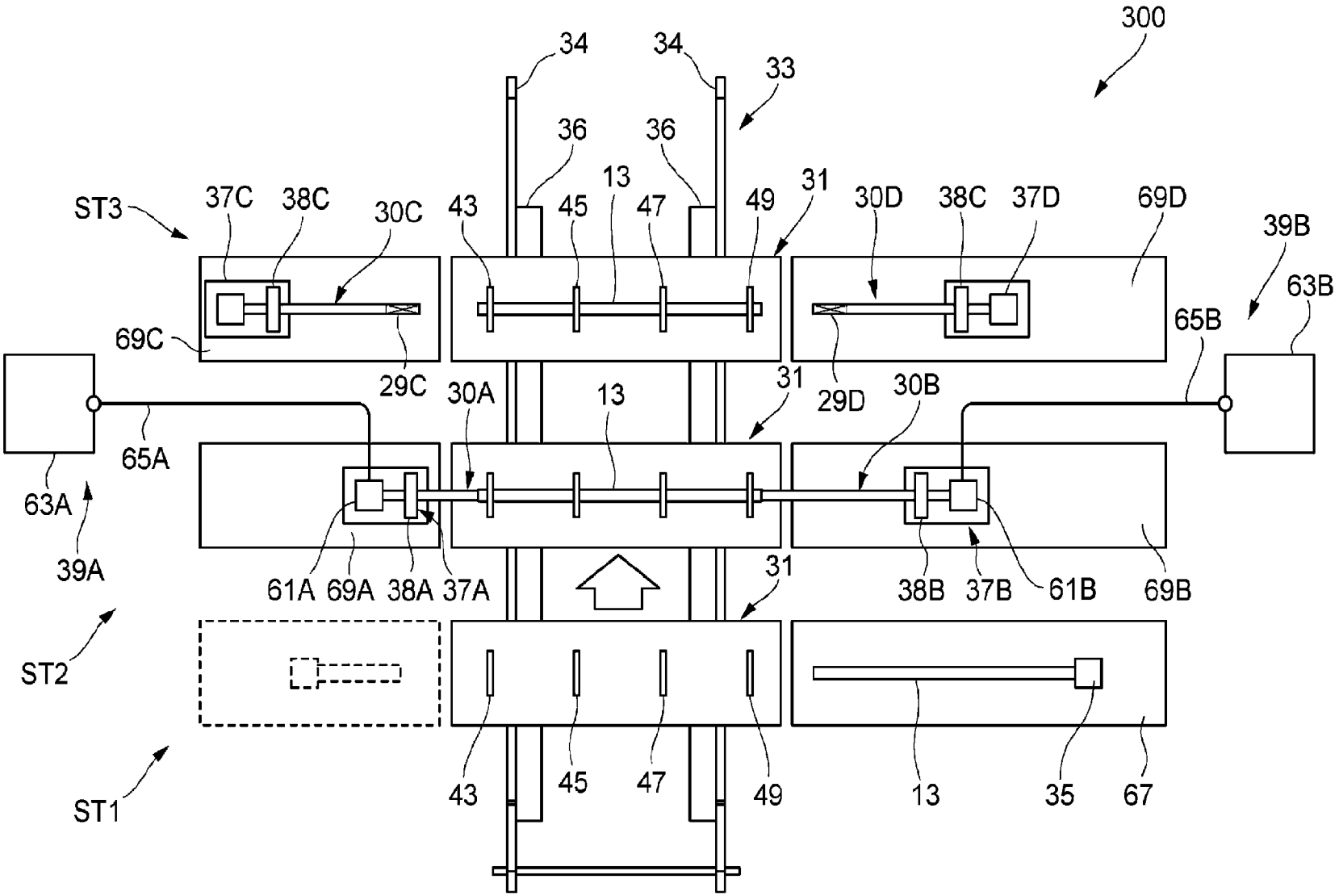
FIG. 20A is an outline plan view of the electromagnetic-forming apparatus and illustrates one of a series of steps included in a tube-expanding process in which an aluminum tube member is expanded by inserting electromagnetic-forming coil portions into the aluminum tube member supported by a jig plate.
Figure 20B:
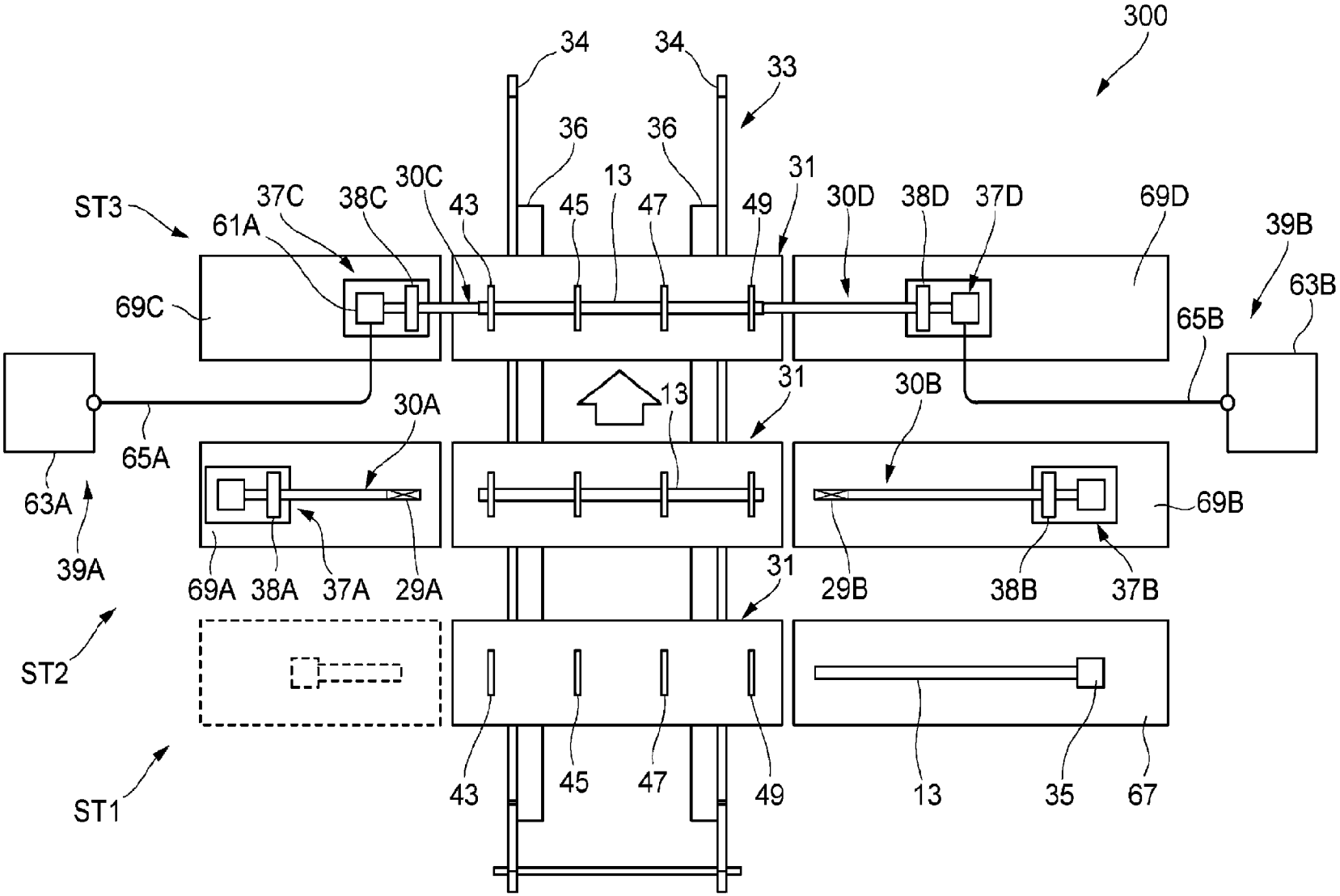
FIG. 20B is an outline plan view of the electromagnetic-forming apparatus and illustrates another one of a series of steps included in the tube-expanding process in which the aluminum tube member is expanded by inserting the electromagnetic-forming coil portions into the aluminum tube member supported by the jig plate.

FIG. 19 is an outline plan view of an electromagnetic-forming apparatus 300 according to the third exemplary configuration. FIGS. 20A and 20B are also outline plan views of the electromagnetic-forming apparatus 300 and illustrate a series of steps included in a tube-expanding process in which an aluminum tube member 13 is expanded by inserting electromagnetic-forming coil portions into the aluminum tube member 13 supported by a jig plate 31.

The electromagnetic-forming apparatus 300 according to the present configuration does not include the first coil-transporting mechanism 92A and the second coil-transporting mechanism 92B included in the electromagnetic-forming apparatus 100 illustrated in FIG. 13A, but includes a base 69C carrying a third coil unit 30C and a base 69D carrying a fourth coil unit 30D on the tube-expansion stage ST3. The base 69C further carries a third coil-moving mechanism 37C that supports the third coil unit 30C. The base 69D further carries a fourth coil-moving mechanism 37D that supports the fourth coil unit 30D. The electromagnetic-forming apparatus 300 does not include the current-supplying units 39C and 39D illustrated in FIG. 13A. Instead, the current-supplying units 39A and 39B are used for both of the tube-expansion stages ST2 and ST3.

<Electromagnetic Forming of Aluminum Tube Member>

A tube-member-forming method will now be described sequentially in which the formed body 11 illustrated in FIG. 1 is obtained through electromagnetic forming performed by the electromagnetic-forming apparatus 300 configured as above. The following description concerns steps to be performed after the jig plate 31 supporting the aluminum tube member 13 on the tube-insertion stage ST1 illustrated in FIG. 13A is transported to the tube-expansion stage ST2 by the jig-plate-transporting mechanism 33.

(Unit-Inserting Step)

As illustrated in FIG. 20A, the first coil-moving mechanism 37A and the second coil-moving mechanism 37B move the first coil unit 30A and the second coil unit 30B, respectively, toward the jig plate 31. Thus, the first coil unit 30A and the second coil unit 30B are inserted into the aluminum tube member 13.

(Coil-Positioning Step)

As with the case illustrated in FIG. 12C, the first electromagnetic-forming coil portion 29A and the second electromagnetic-forming coil portion 29B at the distal ends of the first coil unit 30A and the second coil unit 30B inserted into the aluminum tube member 13 are moved to respective desired forming positions. Specifically, the first electromagnetic-forming coil portion 29A is moved to an axial-direction position coinciding with the supporting member 45, and the second electromagnetic-forming coil portion 29B is moved to an axial-direction position coinciding with the supporting member 47.

(Terminal-Connecting Step)

The power-side terminals 145 and 147 are connected to the coil-side terminals 119 and 121 of the first coil unit 30A and the second coil unit 30B, respectively.

(Forming Step)

The power sources 63A and 63B of the current-supplying units 39A and 39B energize the first electromagnetic-forming coil portion 29A and the second electromagnetic-forming coil portion 29B, respectively, whereby the aluminum tube member 13 is expanded.

(Terminal-Separating Step)

After the tube expansion, the power-side terminals 145 and 147 are separated from the coil-side terminals 119 and 121 of the first coil unit 30A and the second coil unit 30B, respectively.

(Unit-Removing Step)

Then, the first coil-moving mechanism 37A and the second coil-moving mechanism 37B move the first coil unit 30A and the second coil unit 30B in respective directions away from the jig plate 31. Thus, the first coil unit 30A and the second coil unit 30B are removed from the aluminum tube member 13.

(Transporting Step)

The jig plate 31 supporting the aluminum tube member 13 from which the first coil unit 30A and the second coil unit 30B have been removed is transported by the jig-plate-transporting mechanism 33 from the tube-expansion stage ST2, i.e. the current processing stage, to the tube-expansion stage ST3, i.e. the next processing stage.

(Unit-Inserting Step)

Then, as illustrated in FIG. 20B, the third coil-moving mechanism 37C and the fourth coil-moving mechanism 37D move the third coil unit 30C and the fourth coil unit 30D, respectively, toward the jig plate 31. Thus, the third coil unit 30C and the fourth coil unit 30D are inserted into the aluminum tube member 13.

(Coil-Positioning Step)

The third electromagnetic-forming coil portion 29C and the fourth electromagnetic-forming coil portion 29D at the distal ends of the third coil unit 30C and the fourth coil unit 30D inserted into the aluminum tube member 13 are moved to respective next forming positions. Specifically, the third coil-moving mechanism 37C and the fourth coil-moving mechanism 37D move the third coil unit 30C and the fourth coil unit 30D in the axial direction until the third electromagnetic-forming coil portion 29C reaches an axial-direction position coinciding with the supporting member 43 and the fourth electromagnetic-forming coil portion 29D reaches an axial-direction position coinciding with the supporting member 49.

(Terminal-Connecting Step)

As with the case illustrated in FIG. 12C, the power-side terminals 145 and 147 are connected to the coil-side terminals 119 and 121 of the third coil unit 30C and the fourth coil unit 30D, respectively.

(Forming Step)

The power sources 63A and 63B of the current-supplying units 39A and 39B energize the third electromagnetic-forming coil portion 29C and the fourth electromagnetic-forming coil portion 29D, respectively, whereby the aluminum tube member 13 is electromagnetically formed.

(Terminal-Separating Step)

The power-side terminals 145 and 147 are separated from the coil-side terminals 119 and 121 of the third coil unit 30C and the fourth coil unit 30D.

(Unit-Removing Step)

The third coil-moving mechanism 37C and the fourth coil-moving mechanism 37D move the third coil unit, 30C and the fourth coil unit 30D in respective directions away from the jig plate 31. Thus, the third coil unit 30C and the fourth coil unit 30D are removed from the aluminum tube member 13.

As a result of the above process, the aluminum tube member 13 is clinched to the brackets 15, 17, 19A, and 19B.

Then, after the above electromagnetic forming, the bracket holders 51, 53, 55, and 57 included in the respective supporting members 43, 45, 47, and 49 illustrated in FIG. 3 are loosened, so that the formed body 11 having the brackets fixed thereto by clinching is removed.

In the above electromagnetic-forming apparatus 300, since the current-supplying units 39A and 39B are shared between the tube-expansion stages ST2 and ST3, the equipment cost of the electromagnetic-forming apparatus 300 can be reduced. Furthermore, before the jig plate 31 is transported from the tube-expansion stage ST2 to the tube-expansion stage ST3, the coil-side terminals 119 and 121 and the power-side terminals 145 and 147 are separated from each other. Hence, there is no need to fold or extend the high-voltage power cables 65A and 65B. Therefore, electromagnetic forming can be performed simply and with increased workability without damaging the high-voltage power cables 65A and 65B.

In the above electromagnetic-forming apparatus 300, processing different from the processing performed on the tube-expansion stage ST2 can be performed on the tube-expansion stage ST3 provided with the third coil unit 30C and the fourth coil unit 30D.

While the above exemplary configurations each concern a terminal configuration in which coil-side terminals and power-side terminals all having plate-shapes are stacked and connected to each other, the terminal configuration is not limited thereto.

Figure 21:
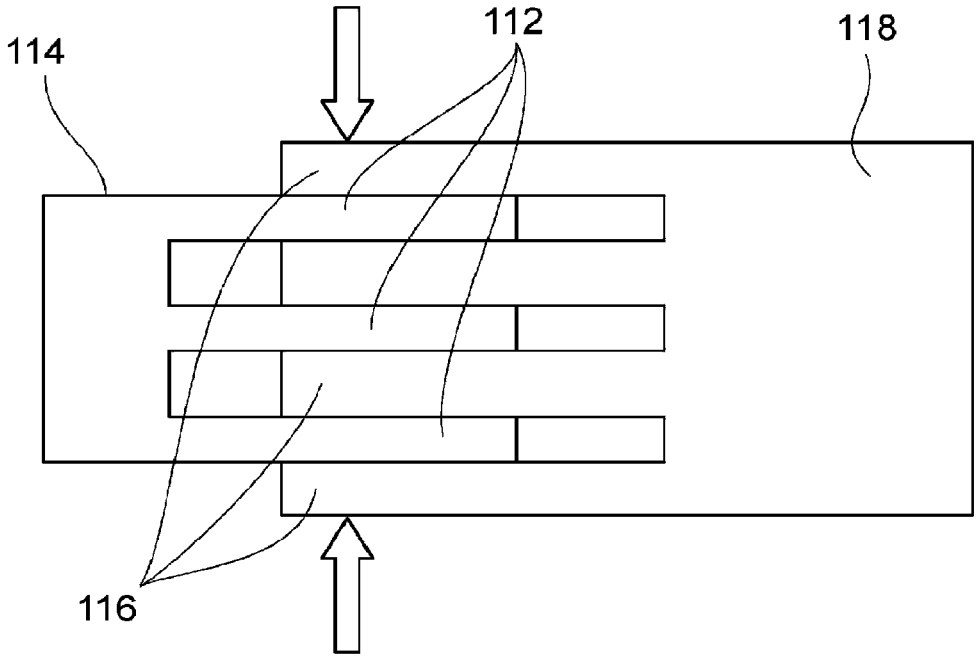
FIG. 21 is an outline diagram illustrating a modification of the terminal configuration.

FIG. 21 is an outline diagram illustrating a modification of the terminal configuration.

The terminal configuration according to the present modification includes coil-side terminals formed as a coil-side terminal block 114 having a plurality of comb teeth 112, and power-side terminals formed as a power-side terminal block 118 having a plurality of comb teeth 116.

In this terminal configuration, the comb teeth 112 of the coil-side terminal block 114 and the comb teeth 116 of the power-side terminal block 118 are meshed with each other. Thus, the coil-side terminal block 114 and the power-side terminal block 118 are connected to and become electrically continuous with each other. The two in this configuration are in surface contact with each other in the meshed part. Therefore, sparks are less likely to be generated.

While the aluminum tube member 13 described above is a single straight tube, the aluminum tube member 13 is not limited thereto. The aluminum tube member 13 may be a combination of two tube members. For example, the aluminum tube member 13 may be formed of a small-diameter tube member and a large-diameter tube member having a larger diameter than the small-diameter tube member that are joined with an end of one of the tube members being fitted in an end of the other tube member. Moreover, the aluminum tube member 13 may include three or more tube members that are joined to one another.

<Fourth Exemplary Configuration of Electromagnetic-Forming Apparatus>

A fourth exemplary configuration of the electromagnetic-forming coil unit will now be described.

Figure 22:
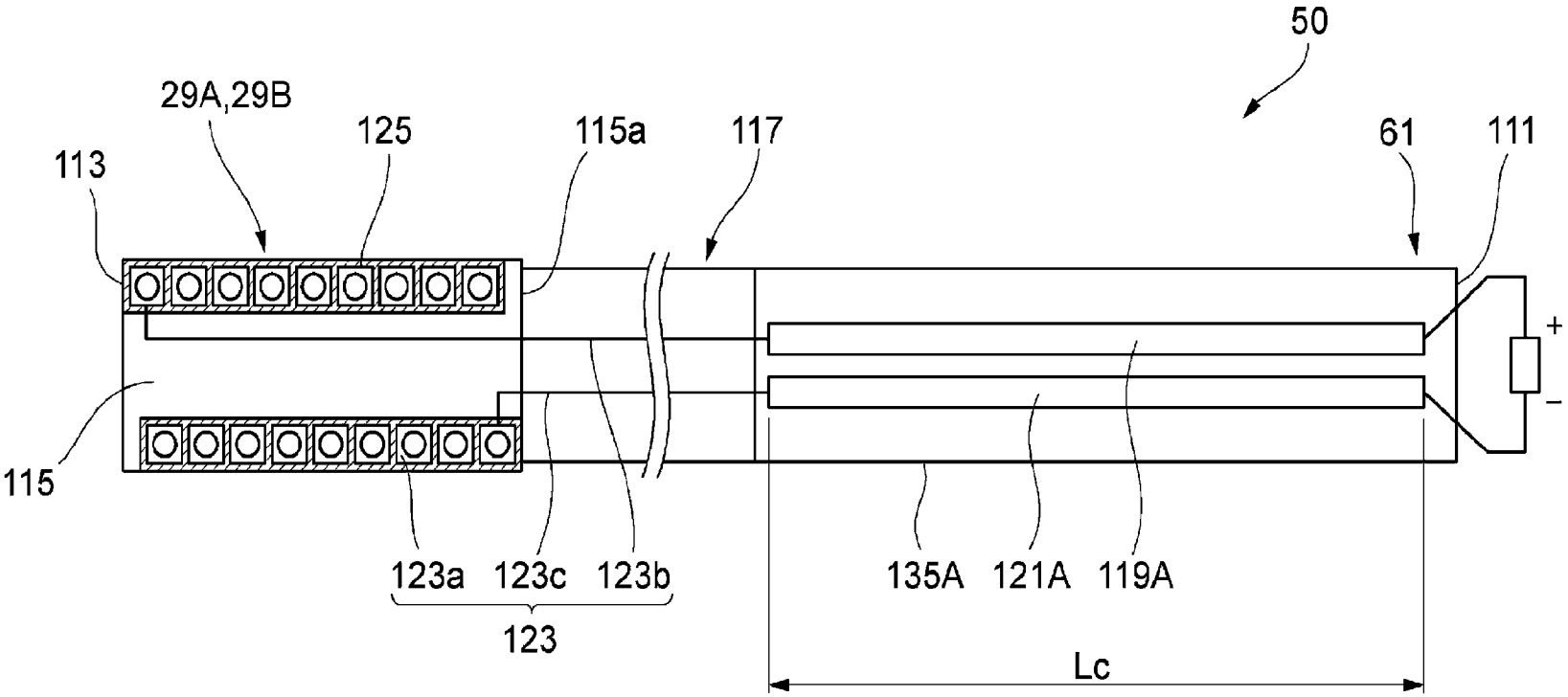
FIG. 22 is a schematic diagram of an electromagnetic-forming coil unit according to a fourth exemplary configuration.

FIG. 22 is a schematic diagram of an electromagnetic-forming coil unit 50 according to the fourth exemplary configuration.

An electromagnetic-forming coil unit 50 according to the present configuration includes the core member 115, the insulating support 117, and the conductor 123 that have been described above, and a coil-side-terminal-supporting portion 135A.

The coil-side-terminal-supporting portion 135A is longer in the axial direction than the coil-side-terminal-supporting portion 135 (see FIG. 4) of the electromagnetic-forming coil unit 30 according to the first exemplary configuration. The coil-side-terminal-supporting portion 135A having such an elongated shape supports a pair of elongated coil-side terminals 119A and 121A. The coil-side terminals 119A and 121A each have a plate shape elongated in the lengthwise direction of the electromagnetic-forming coil unit 50, and each have an axial length Lc. The upper surfaces of the coil-side terminals 119A and 121A that are flat over the entirety lengthwise are exposed.

As with the supporting manner implemented by the coil-moving mechanisms 37A and 37B illustrated in FIGS. 12A to 12D, the electromagnetic-forming coil unit 50 is supported by a coil-moving mechanism in such a manner as to be movable in the axial direction. However, a terminal-connecting portion according to the present configuration differs from the terminal-connecting portions 61A and 61B illustrated in FIGS. 12C and 12D that are moved together with the coil-moving mechanisms 37A and 37B. The terminal-connecting portion according to the present configuration is fixed at a specific position in the axial direction.

Figure 23:
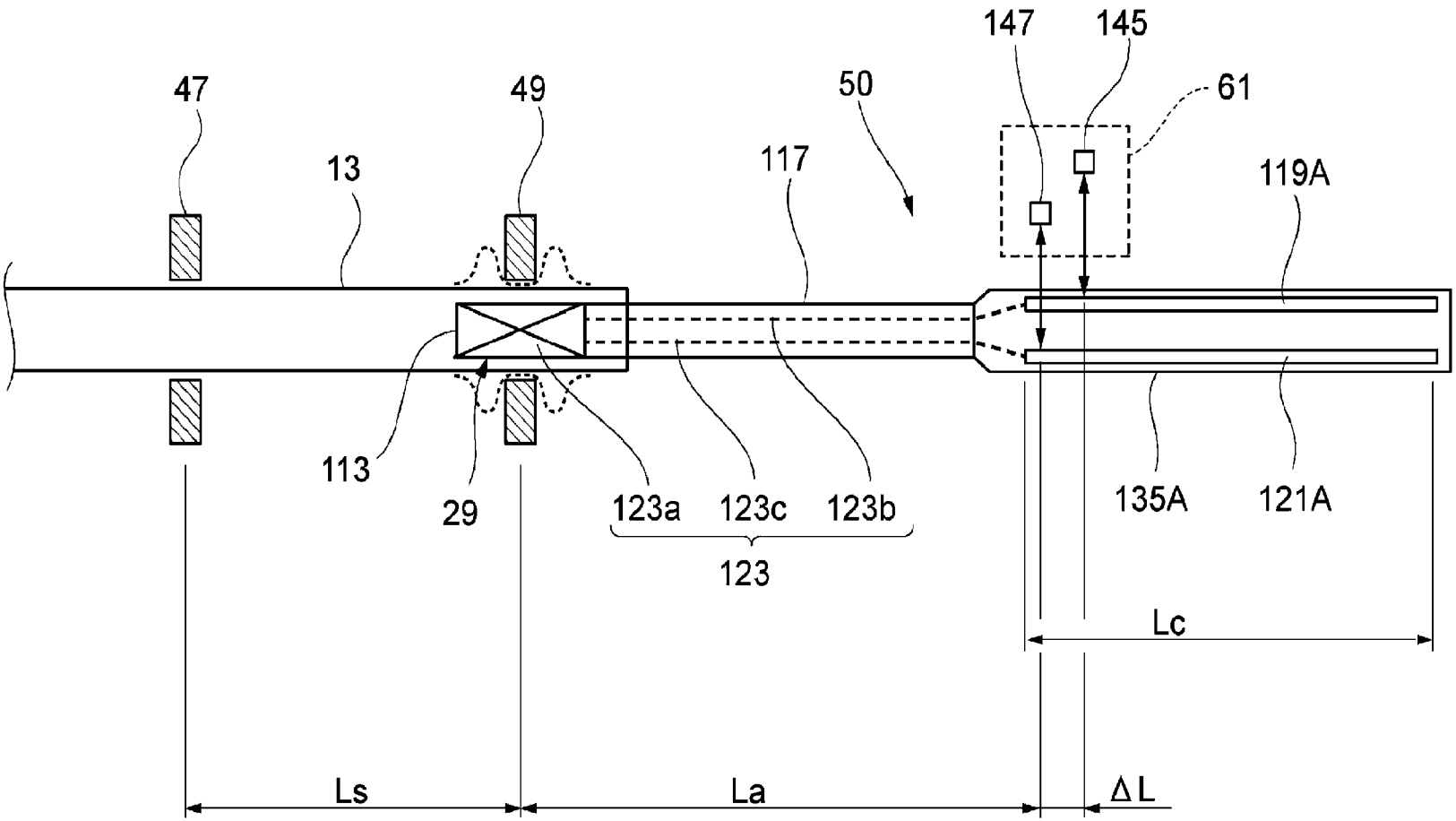
FIG. 23 is a process diagram schematically illustrating a tube-expanding process performed with the electromagnetic-forming coil unit.
Figure 24:
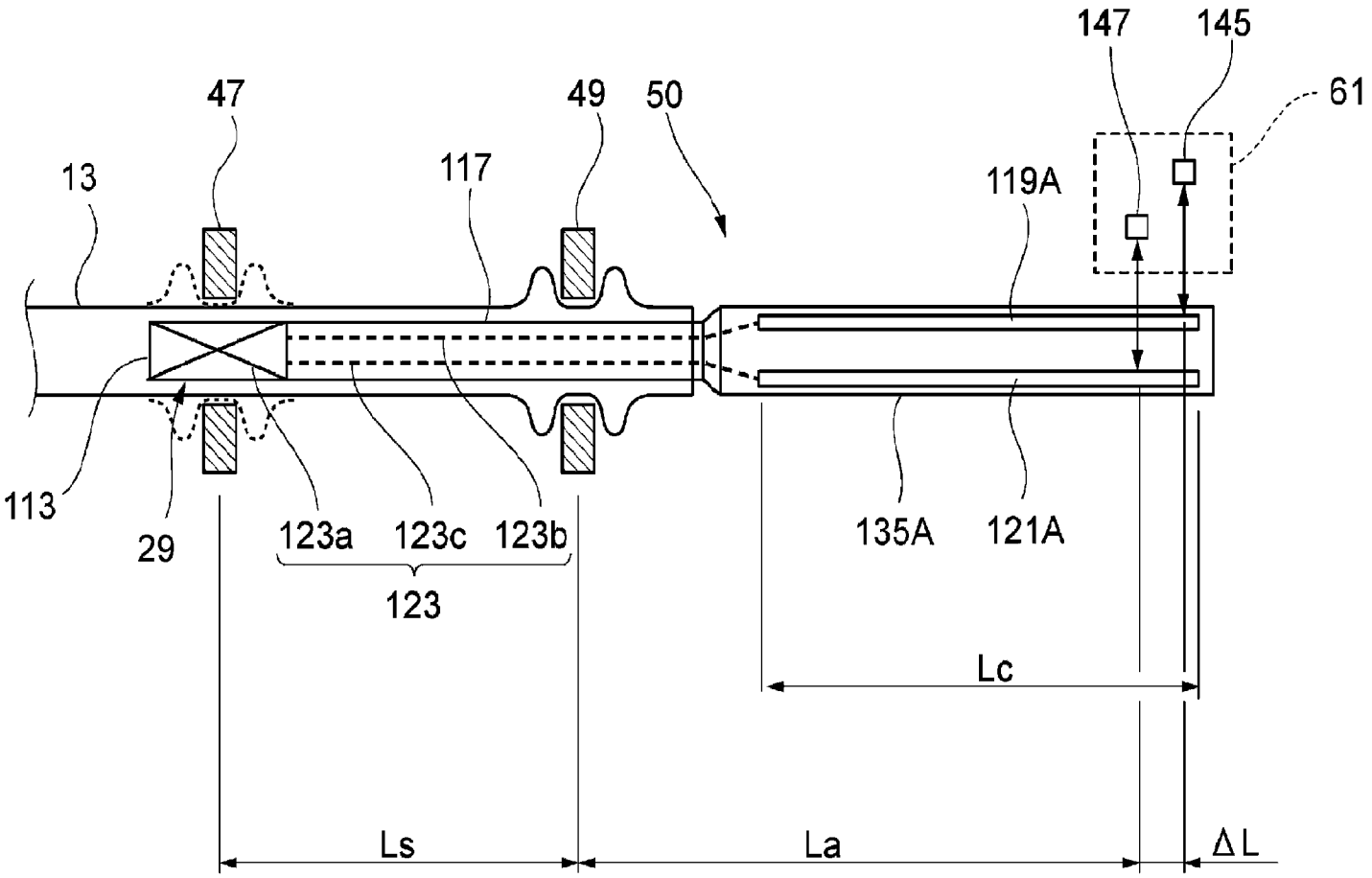
FIG. 24 is another diagram schematically illustrating the tube-expanding process performed with the electromagnetic-forming coil unit.

FIGS. 23 and 24 are process diagrams schematically illustrating a tube-expanding process performed with the electromagnetic-forming coil unit 50.

FIG. 23 illustrates a step of expanding the aluminum tube member 13 at an axial-direction position coinciding with the supporting member 49. FIG. 24 illustrates a step of expanding the aluminum tube member 13 at an axial-direction position coinciding with the supporting member 47.

As illustrated in FIG. 23, the coil-moving mechanism described above inserts a distal end 113 of the electromagnetic-forming coil unit 50 into the aluminum tube member 13 until the coil portion as the wound portion 123*a* reaches the axial-direction position coinciding with the supporting member 49.

With the coil portion being at the position coinciding with the supporting member 49, the coil-side terminals 119A and 121A on the coil-side-terminal-supporting portion 135A are clamped between the pressing member 149 and the supporting table 143, as with the case of the terminal-connecting portion 61 illustrated in FIG. 10. Thus, the power-side terminals 145 and 147 and the coil-side terminals 119A and 121A are pressed against each other to be electrically continuous with each other. Since the terminals are pressed against each other, the electromagnetic-forming coil unit 50 is fixed in the axial direction.

Then, a pulsed current is supplied to the power-side terminals 145 and 147, whereby the aluminum tube member 13 is electromagnetically expanded at the position coinciding with the supporting member 49.

Subsequently, the clamping by the terminal-connecting portion 61 is loosened, whereby the power-side terminals 145 and 147 and the coil-side terminals 119A and 121A are separated from each other. Then, as illustrated in FIG. 24, the coil portion 29 of the electromagnetic-forming coil unit 50 is moved to an axial-direction position coinciding with the supporting member 47.

With the coil portion being at the position coinciding with the supporting member 47, the coil-side terminals 119A and 121A on the coil-side-terminal-supporting portion 135A are clamped between the pressing member 149 and the supporting table 143, as with the above case. In this process, since the power-side terminals 145 and 147 remain still at the respective positions in the axial direction, the positions of the coil-side terminals 119A and 121A that come into contact with the power-side terminals 145 and 147 are changed. In this state, the power-side terminals 145 and 147 and the coil-side terminals 119A and 121A are pressed against each other again to be electrically continuous with each other. Since the terminals are pressed against each other, the electromagnetic-forming coil unit 50 is fixed in the axial direction.

Then, a pulsed current is supplied to the power-side terminals 145 and 147, whereby the aluminum tube member 13 is electromagnetically expanded at the position coinciding with the supporting member 37. Consequently, the formed body expanded as illustrated in FIG. 14B is obtained.

Figure 25:
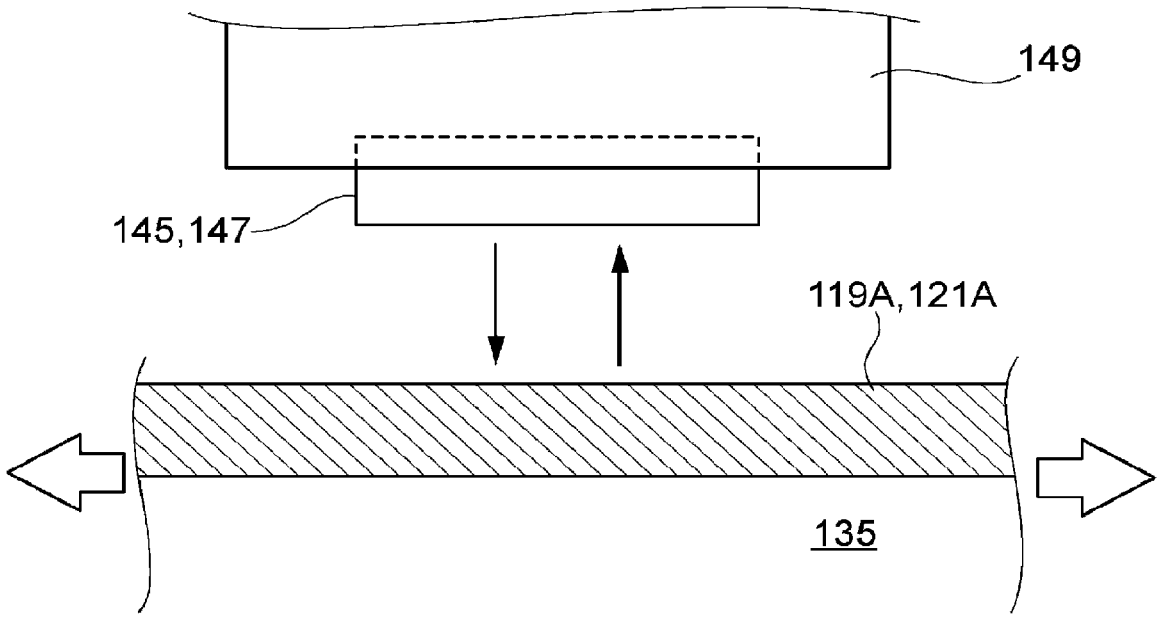
FIG. 25 is an outline diagram illustrating a case where a power-side terminal formed as a plate-shaped electrode terminal is in contact with the coil-side terminal.

As illustrated in FIG. 25, the power-side terminals 145 and 147 are each a flat electrode terminal fixed to the pressing member 149 and whose surface opposing a corresponding one of the coil-side terminals 119A and 121A is flat. When the power-side terminals 145 and 147 and the coil-side terminals 119A and 121A are pressed against each other by the terminal-connecting portion 61, the terminals are in contact with each other over a wide area. Therefore, the probability of short-circuiting or spark generation at the energization is reduced.

The coil-side terminals 119A and 121A each have the axial length Lc greater than or equal to a distance Ls by which the electromagnetic-forming coil unit 50 is moved ($Lc \geq Ls$). That is, the coil-side terminals 119A and 121A each have an axial length greater than or equal to the maximum length of movement of the electromagnetic-forming coil unit 50. Therefore, wherever the electromagnetic-forming coil unit 50 is positioned within the range of movement thereof, the coil-side terminals 119A and 121A and the power-side terminals 145 and 147 are connectable to each other. Hence, the available range of electromagnetic forming is not limited, and the coil can be positioned highly flexibly.

Furthermore, the power-side terminals 145 and 147 each remain still at one specific position while being connected to and separated from a corresponding one of the coil-side terminals 119A and 121A. In such a method, the high-voltage power cables connected to the power-side terminals 145 and 147 do not need to be moved when the forming position is changed. High-voltage power cables are less flexible and heavy and are therefore likely to wear or be damaged when rubbed while being moved. In the present configuration, however, the cables do not need to be moved. Therefore, the process of moving the electromagnetic-forming coil unit can be simplified, increasing the workability and the durability of the electromagnetic-forming apparatus.

Furthermore, since the electromagnetic-forming coil unit 50 is firmly fixed in the axial direction during tube expansion by electromagnetic forming, stable electromagnetic forming with no displacement is realized.

<Modification 1>

The above power-side terminals 145 and 147 of a contact-separation type are each not limited to have a plate shape and may each be a disc-shaped electrode terminal.

Figure 26:
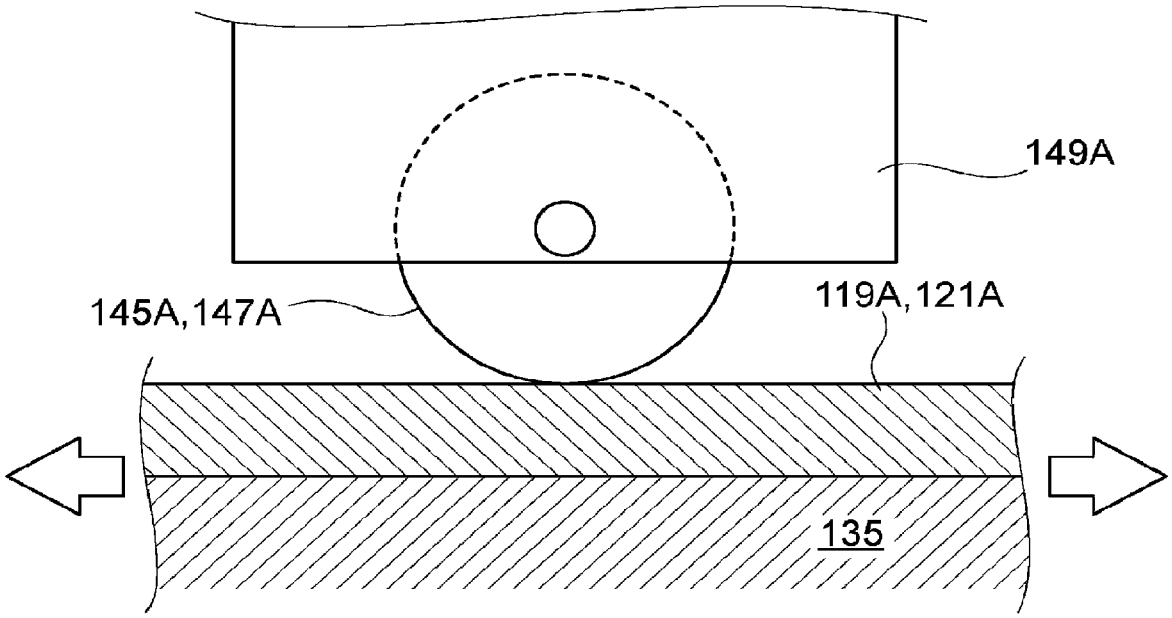
FIG. 26 is an outline diagram illustrating a case where a power-side terminal formed as a disc-shaped electrode terminal is in contact with the coil-side terminal.

FIG. 26 is an outline diagram illustrating a case where power-side terminals 145A and 147A formed as disc-shaped electrode terminals are in contact, with the coil-side terminals 119A and 121A, respectively.

The power-side terminals 145A and 147A formed as rotatably supported disc-shaped electrode terminals come into rolling contact with the coil-side terminals 119A and 121A. Therefore, the electromagnetic-forming coil unit 50 can be moved among a plurality of forming positions with the power-side terminals 145A and 147A and the coil-side terminals 119A and 121A being kept in contact with each other. Hence, when the electromagnetic-forming coil unit 50 is moved in the axial direction as illustrated in FIGS. 23 and 24, the coil-side terminals 119A and 121A are moved to the respective next forming positions while being kept in contact with the power-side terminals 145A and 147A. A fixing mechanism, not illustrated, preventing the movement of the electromagnetic-forming coil unit 50 in the axial direction may be provided at each of the forming positions. Alternatively, the clamping force of the terminal-connecting portions 61, 61A, and 61B illustrated in FIGS. 10 and 17 may be increased to prevent the movement in the axial direction.

The electromagnetic-forming coil unit 50 moves while being pressed by the power-side terminals 145 and 147A and is therefore supported stably while moving. Hence, compared with the case employing the power-side terminals of the contact-separation type, the electromagnetic-forming coil unit 50 are movable in the axial direction with increased workability and smoothly. Hence, high positioning accuracy can be achieved easily.

The disc-shaped electrode terminals may each be formed of not only a single disc but also a combination of a plurality of discs or a plurality of lines of discs. The latter cases produce advantageous effects such as an increase in the contact area, a reduction in the resistance in movement, and suppression of the occurrence of short-circuiting or spark generation at energization.

<Modification 2>

Figure 27:
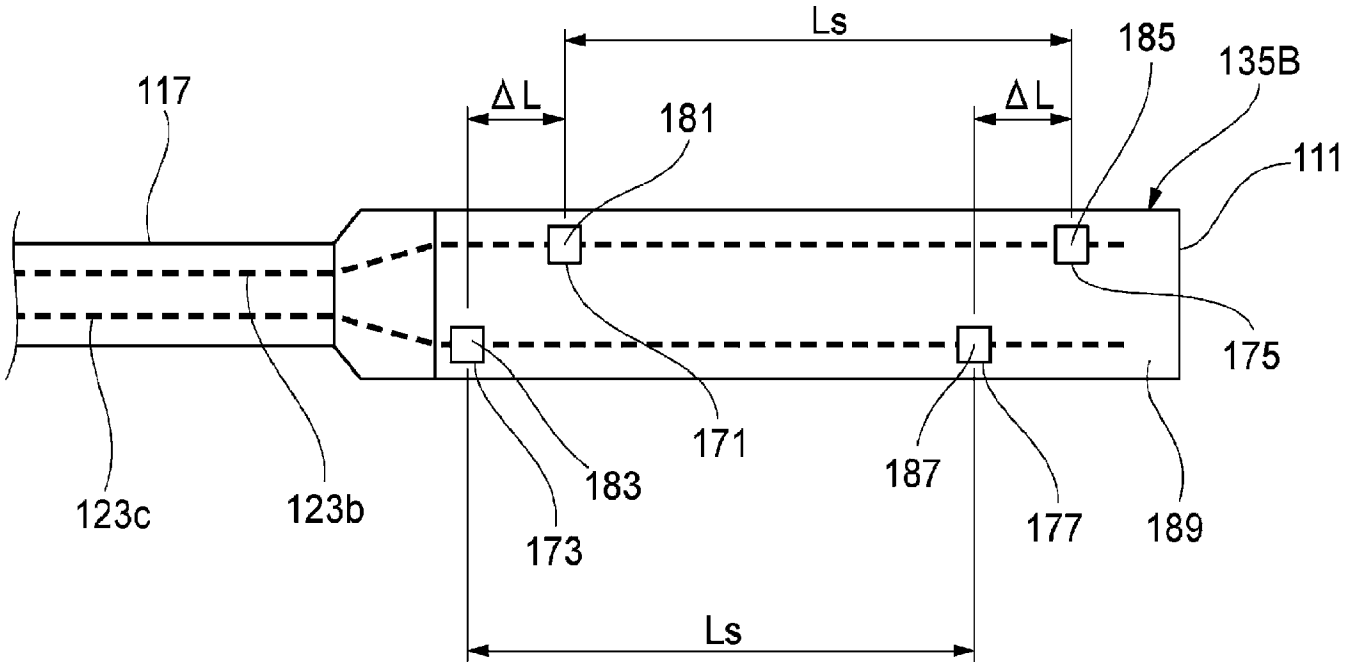
FIG. 27 is an outline diagram illustrating another exemplary configuration of the electromagnetic-forming coil unit.

FIG. 27 is an outline diagram illustrating another exemplary configuration of the electromagnetic-forming coil unit.

A coil-side-terminal-supporting portion 135B of an electromagnetic-forming coil unit according to the present configuration has a pair of contact windows 171 and 173 provided near one end of the insulating support 117, and a pair of contact windows 175 and 177 provided near the proximal end 111.

The contact windows 171 and 175 are provided with coil-side terminals 181 and 185, respectively, connected to the conductor lead 123*b*. The contact windows 173 and 177 are provided with coil-side terminals 183 and 187, respectively, connected to the conductor lead 123*c*. The coil-side terminals 181 and 185 are provided at different, positions, respectively, of the conductor lead 123*b*. The coil-side terminals 183 and 187 are provided at different positions, respectively, of the conductor lead 123*c*. The surface of the coil-side-terminal-supporting portion 135B in which the contact windows 171, 173, 175, and 177 are provided is covered with an electrically insulating layer 189, except areas where the contact windows 171, 173, 175, and 177 are provided.

The contact windows 171 and 173 near the insulating support 117 are provided at positions corresponding to the power-side terminals 145 and 147, respectively, illustrated in FIGS. 23 and 24 and are spaced apart from each other by a distance ΔL in the axial direction for a higher insulating characteristic. The contact windows 175 and 177 near the proximal end 111 are also provided at the positions corresponding to the power-side terminals 145 and 147, respectively, and are spaced apart from each other by a distance ΔL in the axial direction.

The contact window 171 and the contact window 175 are spaced apart from each other in the axial direction by a distance Ls equal to a distance Ls between the supporting member 47 and the supporting member 49 illustrated in FIGS. 23 and 24. The contact window 173 and the contact window 177 are also spaced apart from each other in the axial direction by the distance Ls.

When the aluminum tube member 13 is expanded at the axial-direction position coinciding with the supporting member 49 as illustrated in FIG. 23, the electromagnetic-forming coil unit configured as above is positioned in the axial direction such that the contact windows 171 and 173 face the power-side terminals 145 and 147, respectively. Hence, the contact windows 171 and 173 provide connections to the respective coil-side terminals 119A and 121A. Furthermore, when the aluminum tube member 13 is expanded at the axial-direction position coinciding with the supporting member 47 as illustrated in FIG. 24, the contact windows 175 and 177 are positioned in the axial direction in such a manner as to face the power-side terminals 145 and 147, respectively, and provide connections to the respective coil-side terminals 119A and 121A.

As illustrated in FIGS. 23 and 24, the power-side terminals 145 and 147 in the present configuration can each be retained at a distance La from the supporting member 49 in the axial direction, regardless of the position of tube expansion. That is, there is no need to move the power-side terminals 145 and 147 in the axial direction even if the position of tube expansion is changed. Hence, electromagnetic forming can be performed at a plurality of axial-direction positions repeatedly with the high-voltage power cables connected to the power-side terminals 145 and 147 being fixed. Accordingly, a more efficient process of expanding a plurality of portions of the tube can be realized.

The present invention is not limited to the above embodiments. Any combination of features according to the embodiments and any change or application made to the embodiments by those skilled in the art in accordance with the description given herein or known techniques are expected in the present invention and are included in the scope to be claimed.

The present application claims the benefit of Japanese Patent Application (No. 2017-136634) filed Jul. 12, 2017 and Japanese Patent Application (No. 2018-21084) filed Feb. 8, 2018, the entire contents of which are incorporated herein by reference.

REFERENCE SIGNS LIST

13 aluminum tube member (tube member)
29A first electromagnetic-forming coil portion
29B second electromagnetic-forming coil portion
29C third electromagnetic-forming coil portion
29D fourth electromagnetic-forming coil portion
30, 40, 50 electromagnetic-forming coil unit (coil unit)
30A first coil unit
30B second coil unit
30C, 40A third coil unit
30D, 40B fourth coil unit
63A, 63B, 63C, 63D power source

65A, 65B, 65C, 65D high-voltage power cable (power cable)

100, 200, 300 electromagnetic-forming apparatus

119, 119A, 121, 121A coil-side terminal

145, 145A, 147, 147A power-side terminal

ST2, ST3 tube-expansion stage

The invention claimed is:

1. A tube-member-forming method comprising, in the following order:

inserting a bar-shaped coil unit having an electromagnetic-forming coil portion into a tube member from a distal part of the coil unit;

positioning the electromagnetic-forming coil portion at a forming position of the tube member;

connecting a coil-side terminal and a power-side terminal to each other, the coil-side terminal being provided in a proximal part of the coil unit and being electrically continuous with the electromagnetic-forming coil portion, the power-side terminal being provided at an end of a power cable extending from a power source;

electromagnetically forming the tube member by supplying a current from the power source to the electromagnetic-forming coil portion;

separating the coil-side terminal and the power-side terminal from each other; and removing the coil unit from the tube member, wherein the coil-positioning step is performed by moving the coil unit such that the electromagnetic-forming coil portion is positioned among a plurality of different positions of the tube member, and wherein the terminal-connecting step, the forming step, and the terminal-separating step are performed at each of the different positions.

2. The tube-member-forming method according to claim 1, wherein the coil-side terminal and the power-side terminal each have a plate shape, and the terminal-connecting step is performed by stacking the coil-side terminal and the power-side terminal one on top of the other to be fixed.

3. The tube-member-forming method according to claim 2, further comprising, after the separating:

transporting the tube member and the coil unit from a current processing stage to a next processing stage, with the coil unit being placed in the tube member, wherein the positioning, the connecting, the forming, and the separating are performed again in that order on a next processing stage.

4. The tube-member-forming method according to claim 1, further comprising, after the separating:

transporting the tube member and the coil unit from a current processing stage to a next processing stage, with the coil unit being placed in the tube member, wherein the positioning, the connecting, the forming, and the separating are performed again in that order on a next processing stage.

5. A tube-member-forming method comprising, in the following order:

inserting a bar-shaped coil unit having an electromagnetic-forming coil portion into a tube member from a distal part of the coil unit;

positioning the electromagnetic-forming coil portion at a forming position of the tube member;

connecting a coil-side terminal and a power-side terminal to each other, the coil-side terminal being provided in a proximal part of the coil unit and being electrically continuous with the electromagnetic-forming coil portion, the power-side terminal being provided at an end of a power cable extending from a power source;

electromagnetically forming the tube member by supplying a current from the power source to the electromagnetic-forming coil portion;

separating the coil-side terminal and the power-side terminal from each other;

transporting the tube member and the coil unit from a current processing stage to a next processing stage, with the coil unit being placed in the tube member; and removing the coil unit from the tube member, wherein the positioning, the connecting, the forming, and the separating are performed again in that order on a next processing stage.

* * * * *